US010272282B2

(12) United States Patent
Harlow

(10) Patent No.: US 10,272,282 B2
(45) Date of Patent: Apr. 30, 2019

(54) SYSTEMS AND METHODS FOR PROVIDING ERGONOMIC CHAIRS

(71) Applicant: Corecentric LLC, Fort Lauderdale, FL (US)

(72) Inventor: Bryce Harlow, Fort Lauderdale, FL (US)

(73) Assignee: Corecentric LLC, Fort Lauderdale, FL (US)

( * ) Notice: Subject to any disclaimer, the term of this patent is extended or adjusted under 35 U.S.C. 154(b) by 0 days.

(21) Appl. No.: 15/270,933

(22) Filed: Sep. 20, 2016

(65) Prior Publication Data

US 2018/0078812 A1 Mar. 22, 2018

(51) Int. Cl.
*A47C 1/022* (2006.01)
*A63B 21/16* (2006.01)
(Continued)

(52) U.S. Cl.
CPC ..... *A63B 21/1609* (2015.10); *A47C 1/022* (2013.01); *A47C 7/004* (2013.01); *A47C 7/006* (2013.01); *A47C 7/02* (2013.01); *A47C 7/38* (2013.01); *A47C 7/402* (2013.01); *A47C 7/405* (2013.01); *A47C 7/441* (2013.01); *A47C 7/443* (2013.01); *A47C 7/46* (2013.01); *A47C 7/48* (2013.01); *A47C 7/54* (2013.01); *A47C 7/746* (2013.01); *A63B 21/04* (2013.01); *A63B 21/045* (2013.01); *A63B 23/0205* (2013.01)

(58) Field of Classification Search
CPC ... A63B 21/1609; A63B 21/04; A63B 21/045; A63B 23/0205; A47C 1/022; A47C 7/004; A47C 7/006; A47C 7/02; A47C 7/38; A47C 7/402; A47C 7/44; A47C 7/441; A47C 7/46; A47C 7/54; A47C 7/74; A47C 7/742; A47C 7/744; A47C 7/746
See application file for complete search history.

(56) References Cited

U.S. PATENT DOCUMENTS 148,380 A * 3/1874 Perrenet
3,552,797 A * 1/1971 Houdain ..... A47C 7/42 297/354.1

(Continued)

FOREIGN PATENT DOCUMENTS

| | | |
|---|---|---|
| DE | WO2014198255 | 12/2014 |
| KR | 20110026278 | 3/2011 |
| WO | WO-2012044010 | 4/2012 |

OTHER PUBLICATIONS http://www.gymygym.com/how-it-works, last accessed Aug. 29, 2015.

(Continued)

*Primary Examiner* — Philip F Gabler
(74) *Attorney, Agent, or Firm* — RegitzMauck PLLC; Dustin Mauck; Mike Regitz

(57) ABSTRACT

A chair for providing support to a user's spine to improve posture and for providing ways for the user to perform exercises. The chair may include a flexible connection that enables a back support to move side to side through a sidebending range of motion of the user. The back support, which may include a flexible chair spine, may be configured to adapt to the curvature of the user's spine when the user is seated in the chair. A seat of the chair may include channels and vents to improve air circulation within the seat.

19 Claims, 17 Drawing Sheets

(51) Int. Cl.

| | |
|---|---|
| ***A47C 7/00*** | (2006.01) |
| ***A47C 7/02*** | (2006.01) |
| ***A47C 7/38*** | (2006.01) |
| ***A47C 7/40*** | (2006.01) |
| ***A47C 7/44*** | (2006.01) |
| ***A47C 7/46*** | (2006.01) |
| ***A47C 7/54*** | (2006.01) |
| ***A63B 21/04*** | (2006.01) |
| ***A63B 21/045*** | (2006.01) |
| ***A63B 23/02*** | (2006.01) |
| ***A47C 7/48*** | (2006.01) |
| ***A47C 7/74*** | (2006.01) |

(56) References Cited

U.S. PATENT DOCUMENTS

| | | | | |
|---|---|---|---|---|
| 3,818,522 | A | 6/1974 | Schuster | |
| 4,889,387 | A | 12/1989 | Gregory | |
| D320,120 | S | 9/1991 | Samuelsson | |
| 5,044,633 | A | 9/1991 | Rice | |
| 5,577,804 | A | 11/1996 | Tedesco | |
| 5,718,476 | A | 2/1998 | De Pascal et al. | |
| 5,908,221 | A | 6/1999 | Neil | |
| 5,951,109 | A * | 9/1999 | Roslund, Jr. | A47C 1/03255 297/299 |
| 6,059,363 | A * | 5/2000 | Roslund, Jr. | A47C 1/03255 297/301.4 |
| 6,092,871 | A | 7/2000 | Beaulieu | |
| 6,092,872 | A | 7/2000 | Beaulieu | |
| 6,168,237 | B1 | 1/2001 | Lamart et al. | |
| 6,257,668 | B1 | 7/2001 | Chou et al. | |
| 6,572,190 | B2 | 6/2003 | Koepke et al. | |
| 6,589,143 | B2 * | 7/2003 | Taylor | A61H 7/001 297/230.14 |
| 6,709,058 | B1 | 3/2004 | Diffrient | |
| 6,755,467 | B1 | 6/2004 | Chu | |
| 6,799,803 | B1 | 10/2004 | Lee et al. | |
| 6,811,218 | B2 | 11/2004 | Deiman et al. | |
| D501,333 | S | 2/2005 | Piretti | |
| 6,848,744 | B1 | 2/2005 | Raftery et al. | |
| D509,975 | S | 9/2005 | Pan | |
| 6,938,956 | B1 * | 9/2005 | Piretti | A47C 7/38 297/230.14 |
| D512,231 | S | 12/2005 | Landin | |
| 7,025,424 | B2 | 4/2006 | Harley | |
| 7,040,703 | B2 | 5/2006 | Sanchez | |
| 7,195,583 | B2 | 3/2007 | Leib | |
| 7,216,388 | B2 | 5/2007 | Bieganek et al. | |
| 7,322,907 | B2 | 1/2008 | Bowser | |
| 7,396,082 | B2 | 7/2008 | Sanchez | |
| 7,416,251 | B2 * | 8/2008 | Chu | A47C 7/448 297/285 |
| 7,475,946 | B2 | 1/2009 | Diffrient | |
| 7,665,803 | B2 * | 2/2010 | Wolas | A47C 7/744 297/180.1 |
| 7,712,833 | B2 | 5/2010 | Ueda | |
| D623,449 | S | 9/2010 | Diffrient | |
| 7,841,665 | B2 | 10/2010 | Geister et al. | |
| 7,874,619 | B2 | 1/2011 | Harley | |
| 7,909,402 | B2 | 3/2011 | Chu et al. | |
| 7,963,609 | B2 | 6/2011 | Jinkun | |
| 7,980,631 | B2 | 7/2011 | Diffrient | |
| 7,998,045 | B2 | 8/2011 | Splane | |
| 8,104,837 | B2 | 1/2012 | Diffrient | |
| 8,162,402 | B2 | 4/2012 | Yamauchi | |
| D659,421 | S | 5/2012 | Pan | |
| D660,056 | S | 5/2012 | Diffrient | |
| D661,916 | S | 6/2012 | Chen | |
| 8,439,442 | B2 | 5/2013 | Highlander et al. | |
| D694,537 | S | 12/2013 | Smith et al. | |
| D697,730 | S | 1/2014 | Smith et al. | |
| 8,696,534 | B2 | 4/2014 | Karwan | |
| 8,905,906 | B2 | 12/2014 | Man et al. | |
| 8,944,977 | B2 | 2/2015 | Foster et al. | |
| 8,967,724 | B2 | 3/2015 | Battey et al. | |
| 9,004,597 | B2 | 4/2015 | Battey et al. | |
| 9,010,859 | B2 | 4/2015 | Battey et al. | |
| 9,272,643 | B2 * | 3/2016 | Nagayasu | B60N 2/449 |
| D763,588 | S | 8/2016 | Chen | |
| 9,480,340 | B1 | 11/2016 | Harlow | |
| D804,879 | S | 12/2017 | Harlow | |
| 2002/0117883 | A1 | 8/2002 | Gevaert | |
| 2004/0056520 | A1 * | 3/2004 | Cho | A47C 7/405 297/218.1 |
| 2004/0140701 | A1 | 7/2004 | Schmitz et al. | |
| 2008/0197688 | A1 | 8/2008 | Tate | |
| 2011/0266853 | A1 | 11/2011 | Zhou | |
| 2013/0005550 | A1 | 1/2013 | Nagy | |
| 2013/0045845 | A1 | 2/2013 | Verheem | |
| 2013/0169016 | A1 | 7/2013 | Meyuhas | |

OTHER PUBLICATIONS http://www.teknion.com/products/product-details?productLineId=745a336e-8e7a-673b-a6c8-ff00004460c4, last accessed Nov. 23, 2015 (Contessa).

http://www.teknion.com/products/product-details?productLineId=0f5b336e-8e7a-673b-a6c8-ff00004460c4, last accessed Nov. 23, 2015 (Fitz).

http://www.teknion.com/products/product-details?productLineId=b45c336e-8e7a-673b-a6c8-ff00004460c4, last accessed Nov. 23, 2015 (Projek).

http://www.hermanmiller.com/products/seating.html, last accessed Nov. 23, 2015.

http://www.teknion.com/products/product-details?productLineId=4b5d336e-8e7a-673b-a6c8-ff00004460c4, last accessed Nov. 23, 2015 (RBT).

"Teknion—RBT," Brochure, 2012, Teknion.

"Shadow—True Response Support System," Brochure, Feb. 2, 2012, Global U.S.A.

http://www.xchair.com, last accessed Oct. 11, 2016.

PCT International Search Report (PCT EP2017/001114) from related application dated Dec. 4, 2017.

* cited by examiner

SYSTEMS AND METHODS FOR PROVIDING ERGONOMIC CHAIRS

TECHNICAL FIELD

The present invention relates generally to chairs and, more specifically, to chairs such as residential and office chairs that provide flexible seating support that promotes proper posture.

BACKGROUND OF THE INVENTION

Maintaining proper health, fitness and physical appearance are major concerns for people today. However, in many countries, a large section of the population have sedentary jobs. To compound this, many are unable to find the time to exercise because they spend so much time at these sedentary jobs. The typical office worker, for example, is confined to his or her desk about 7.5 hours per day.

In the United States, statistics paint a bleak picture with respect to present day sedentary lifestyles. For example, about 36% of Americans are obese and, with respect to the future working population, one out of three persons under 18 years of age is obese. A significant portion of the United States' medical costs is incurred in treating diseases associated with obesity. At first blush, it may seem that many persons address their lack of exercise on the job by working out at gyms. But only about 15% of Americans have gym memberships and only about 10% of those who have memberships use them.

Sitting for long periods without exercise can have significant negative effects on the body. For example, headaches, mental fatigue, stress-related tension in the shoulders, and accumulation of fluids in the lungs and neck are some of the consequences of sitting for long periods without exercise. One section of the body that is especially susceptible to this is the back. With respect to the back, sitting for long periods without exercise can cause muscle imbalances, weakness, loss of flexibility, pain, arthritis, sciatica, degenerative disc disease, and the like.

Poor posture while sitting is a further issue associated with the modern day sedentary lifestyle. As noted above, sitting for long periods without exercise in and of itself is an health issue, but poor posture complicates this further. Examples of bad sitting posture include a person reclining too much in a chair or leaning out of the chair such that there is no support for the person's back. Currently, chair design is focused on providing proper back support from the lumbar region of the back.

The problems presented by the modern day sedentary lifestyle is of growing concern. At least one city in the United States has considered this issue and has issued guidelines to address it. Specifically, the city of New York has issued "Active Design Guidelines" for designing office space to address obesity and its related diseases. The guidelines seek to provide architects and designers with approaches for designing urban spaces and healthier buildings. For example, the new designs place stairwells in convenient locations so that workers will use the stairs more often. Although buildings are now being designed to facilitate healthier lifestyles, generally, the furniture used in buildings are not designed to facilitate the healthier lifestyle desired by many today.

This patent application relates to application Ser. No. 14/029,189 that is titled "SYSTEMS AND METHODS FOR PROVIDING ERGONOMIC EXERCISE CHAIRS," and Design application No. 29/545,421 that is titled "CHAIR."

Both applications were filed by the same inventor and are commonly owned. While this application does not claim priority to application Ser. No. 14/029,189 or Design application No. 29/545,421, it does hereby incorporate both disclosures herein.

BRIEF SUMMARY OF THE INVENTION

The present invention is directed to systems and methods that provide chairs that change the support provided to a user based on the posture of the user sitting in the chair. The chairs also provide flexibility in movement of the user and the ability to perform exercises. Some of the mechanisms on the chair may have dual functions such that when the chair is being used for seating support and flexibility the mechanisms perform one function and when they are being used as a tool for exercise they perform another or additional function.

Embodiments of the invention include a chair that provides proper support and flexibility for a user's back. For example, embodiments may provide a chair with a back support that bends at least at a section of the back support that is at a level higher than a level of the seat. The bending occurs in response to force from the user when the user sits in the chair. The flexibility of the back support may be provided by a flexible chair spine that adapts to the curvature of the user's spine. This feature creates the necessary compression for pelvic tilt and rotation, while allowing the user to flex and extend. Additional flexibility is provided through a flexible mechanism that allows the user's back to move side to side through a sidebending range of motion. This feature provides natural support and freedom to the user, while enabling the user to exercise his or her oblique muscles by flexing from side to side. These features keep the spine supported and protected through the user's sidebending range of motion.

Embodiments of the invention include a chair that has a flexible back support that delivers resistance in addition to flexibility and serves as a mechanism for a user to perform other core exercises. The flexibility in the back support that engenders this exercise feature may be provided by a flexible chair spine and related mechanisms of the chair. For example, this chair exhibits a recline angle of up to 35°, which is not seen in prior art office chairs.

Embodiments of the invention include a back support comprising at least a lumbosacral support and a thoracic support that may be shaped and designed to support the user's spine. Specifically, the lumbosacral support may be attached to the flexible spine to provide support to the user's lumbar and sacrum portions of the user's spine, while the thoracic support may be attached to the flexible spine to support the user's thoracic portion of the spine. The lumbosacral support may present a concave surface to the user to assist with the shape of the lumbosacral portion of the spine and the thoracic support may present a convex surface to the user to push against this portion of the spine. This design further promotes proper posture of the user.

Embodiments of the invention include a chair having a back support connected to a breathable seat that includes numerous channels and gaps or indentions within the seat and an outer layer including holes or vents surrounding the seat that enable the flow of air through the seat. Springs may also be used within the seat to promote venting and further comfort to the user.

Embodiments of the invention include adjustable arms that are independent and ergonomically designed to fit the user's body. The arms may be connected to the back support to enable independent adjustment to match the user's body and keep the user's upper extremities in the proper position. The adjustable arms are fixed to the spine of the chair to promote flexibility during side to side movement and corresponding oblique abdominal exercises. The adjustment mechanism may be engaged through a button or lever under each armpad, such that the user controls the independent movement of the adjustable arms.

Embodiments of the invention may include employing sensors in at least the lumbosacral support, the thoracic support, and the seat for evaluating the posture of the user and technique during exercise. The sensors may be designed to communicate with a personal device, personal computer, server, or the Internet, such that a computer program can analyze the data from the sensors and provide posture feedback to the user. Specifically, the data from the sensors may be analyzed and presented to the user through a mobile application or website that operates as a "posture coach." If using the chair for exercise, the sensors may be used to track repetitions of specific exercises.

According to embodiments of the invention, a user is provided with an ergonomic exercise chair that helps the user stay fit and healthy. Specifically, the user has at his or her disposal, a chair that encourages proper posture and may be used while in the office, while working, and during work breaks to do exercises throughout a working day. As such, the user may more easily maintain health and fitness and do so at low cost. These benefits to the user may accrue to the user's employer because a happier and healthier employee is one who is more productive, less prone to be absent from work due to sickness, and would incur less health insurance related costs.

According to embodiments, the chair is designed to mimic the movement of the spine by allowing for flexion-extension, sidebending, and rotation, while prior art chairs focused solely on flexion-extension. In prior art chairs, spinal alignment assistance ceases when the user separates from the chair, so the user's spine must compensate. This chair is designed to maintain contact throughout the user's movements to engage the user's core and offer proper support to the spine.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1A:
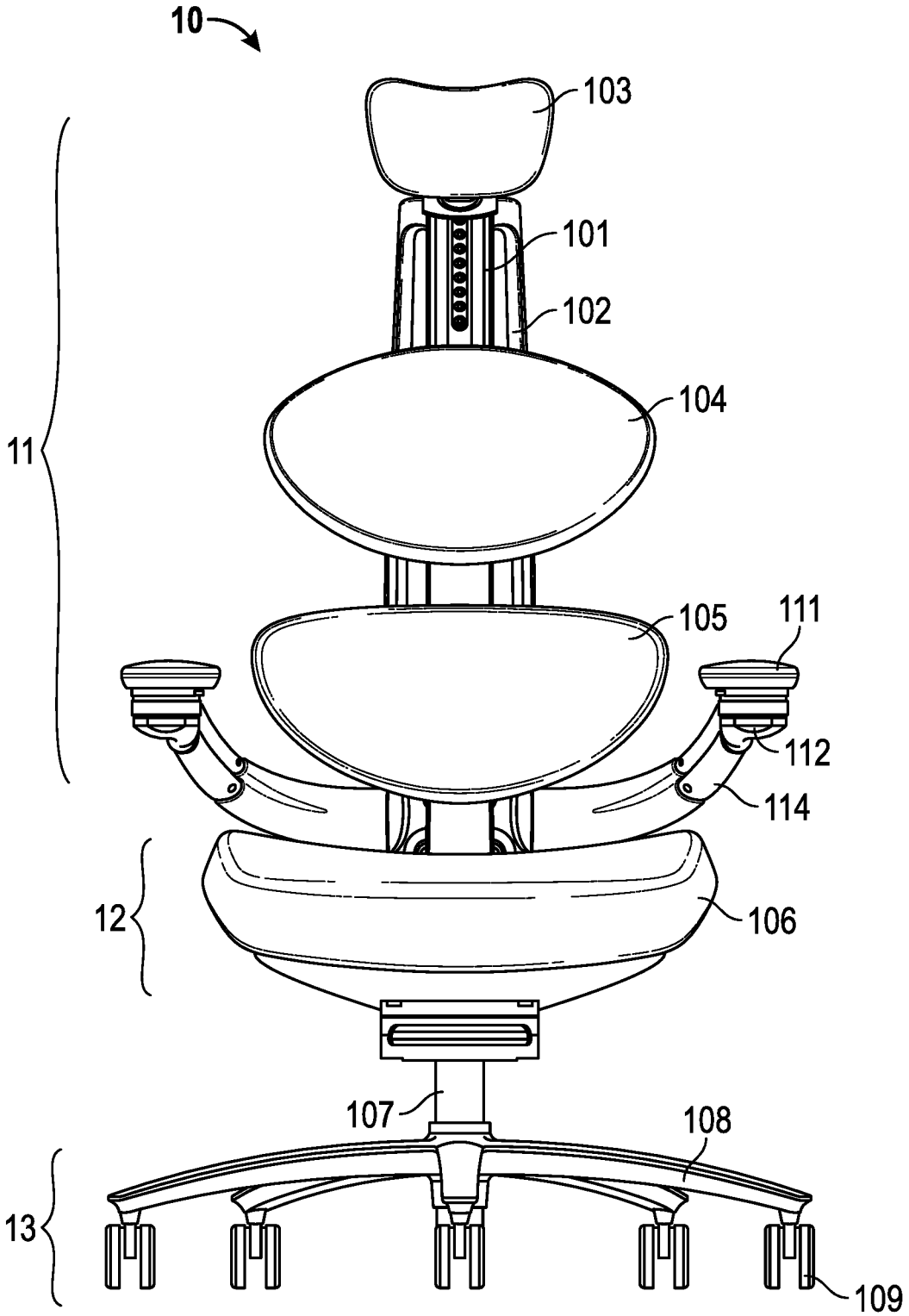
FIGS. 1A-1C show a chair according to embodiments of the invention.
Figure 1B:
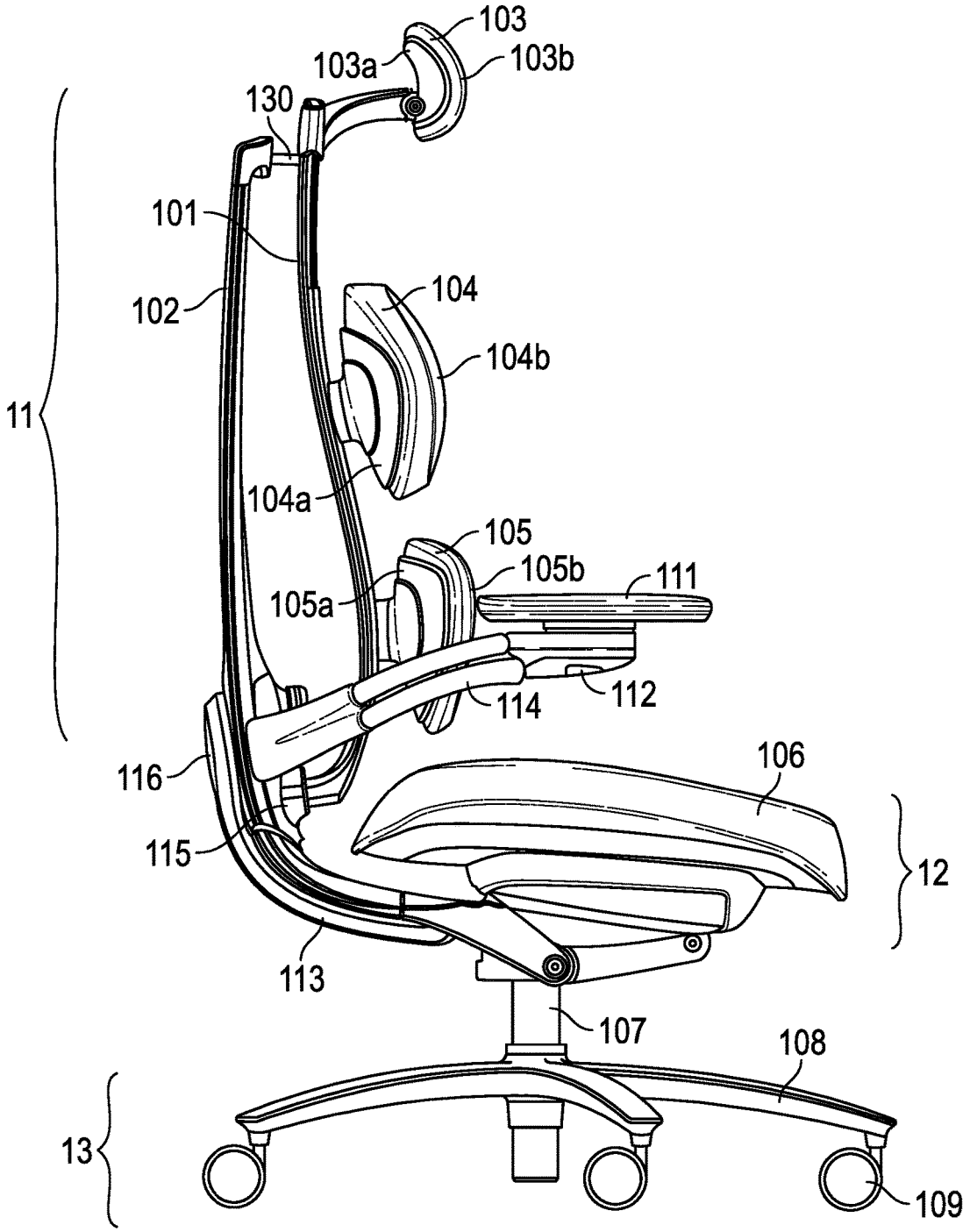
Figure 1C:
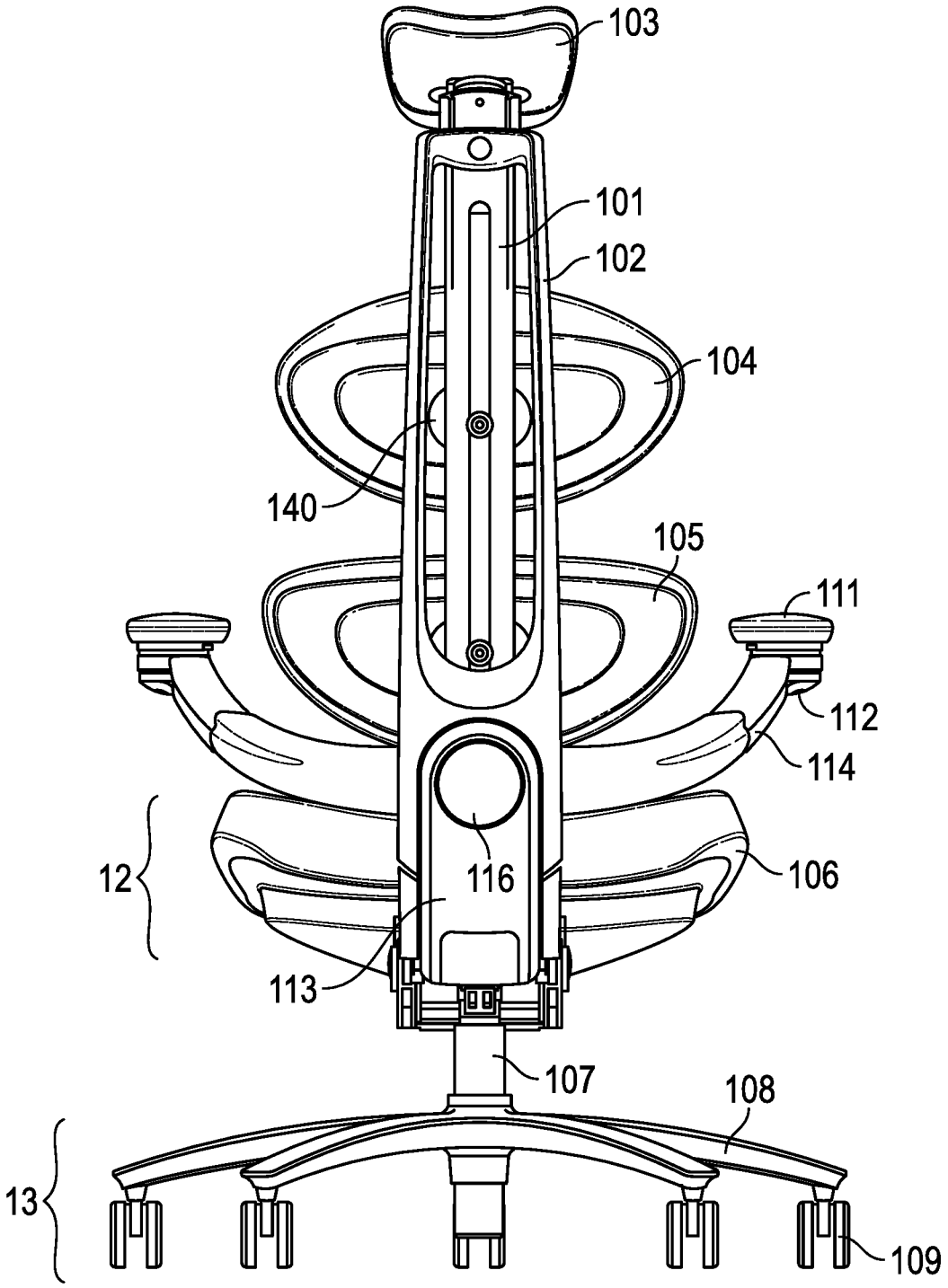

FIG. 1A shows a front view, FIG. 1B shows a side view, and FIG. 1C shows a back view of a chair according to embodiments of the invention. Chair 10 includes chair back support 11, seat 12, and base 13. Chair back support 11 is shown as including flexible chair spine 101, structural back support 102, neck support 103, thoracic support 104, and lumbosacral support 105. The outer portion of neck support 103 may include back 103*a* (made of plastic, metal, the like, or combinations thereof) with an inner layer 103*b* that would be in contact with the neck and base of the skull of a user when seated in chair 10. Inner layer 103*b* may be made of mesh or fabric or the like and may be mechanically connected to back 103*a*, or connected by adhesives such as glue, etc. Inner layer 103*b* may also include egg crate memory foam material. The neck support 103 may be fully adjustable to the user's specifications with respect to height, prominence, and tilt. It should be noted that in some chair embodiments, no neck support 103 is present.

Chair back support 11 includes flexible chair spine 101 and structural back support 102. As shown in FIGS. 1B and 1C, flexible chair spine 101 and structural back support 102 may be oriented in a substantially vertical plane while seat 12 is oriented in a substantially horizontal plane. As used herein, substantially with respect to a particular plane means planes within 5° of the particular plane. Flexible chair spine 101 may be anchored to a structural back support 102 by various methods. Flexible chair spine 101 and structural back support 102 may be mechanically connected at a top portion and a bottom portion of the flexible chair spine 101, wherein the connections may include a ball and socket joint, a mechanical connection, a bolt, or a mechanical gear. In some embodiments, the mechanical connection may allow for adjustment of the flexible chair spine 101 by a user. For example, a knob or button on the chair 10 may allow the user to adjust the shape of the flexible chair spine 101 by adding or releasing tension on the spine 101. This feature enables the user to adjust the flexible chair spine 101 to the shape of his or her spine to improve support and comfort.

It should be noted that, in embodiments of the invention, the flexibility described with respect to flexible spine 101 may be present throughout the length of flexible spine 101. For example, flexible spine 101 may be flexible in the section that supports the lower back of the user, the thoracic area of the user, and the head/neck region of the user. It should be appreciated, however, that in embodiments of the invention the extent of flexibility may vary from one section of flexible spine 101 to another. For example, the section of flexible spine 101 that supports the lower back (connected to lumbosacral support 105) may be less flexible than the section that supports user's thoracic portion of the spine (connected to thoracic support 104), which in turn may be less flexible than the section that supports user's head (connected to neck support 103). Further, any section of flexible section 101 may be configured to bend while other sections may not be able to bend. For example, the section of flexible spine 101 that supports user's thoracic portion of the spine (connected to thoracic support 104) may be configured to bend while other sections, such as the section that supports the user's lower back (connected to lumbosacral support 105), is not able to be bent, or vice versa.

Flexible chair spine 101 and/or structural back support 102 may be connected to seat 12 by various methods. In one embodiment, a J-bar connector 113 may connect the seat 12 to (1) the flexible chair spine 101 at connection 115 and (2) the structural back support 102 at flexible connection mechanism 116. The connector 113, connection 115, and flexible connection mechanism 116 will be described in further detail herein. Flexible chair spine 101 may further be connected to structural back support 102 at or around the neck support 103 with a ball and joint connection 130 or other type of connection. The seat 12, including a seat surface 106 may be connected to the base 13 by various methods, including a pedestal 107. The base 13 may be a five-star base with five arms 108 as shown in FIGS. 1A,1B, and 1C, wherein each arm 108 is connected to a wheel 109.

To provide uniform support to a user's back, flexible chair spine 101 may be connected to a vertical center line of neck support 103, thoracic support 104, and lumbosacral support 105 as shown in FIGS. 1A, 1B, and 1C. As such, a portion of each of neck support 103, thoracic support 104, and lumbosacral support 105 may be located to the left or right of flexible chair spine 101. In this way, the left portions of neck support 103, thoracic support 104, and lumbosacral support 105 may be a mirror image of the respective right portions of neck support 103, thoracic support 104, and lumbosacral support 104. It should be appreciated that flexible chair spine 101 could be implemented as a plurality of elements in back support 11 that are connected to neck support 103, thoracic support 104, and lumbosacral support 104.

Flexible chair spine 101 is flexible and may be made of plastic, fiber glass, carbon fiber etc., so as to allow chair spine 101 to flex and compress depending on user's movement forward or backward in chair 10. Structural back support 102 is more rigid and may be made of metallic or non-metallic materials, such as plastic, carbon fiber, aluminum, etc., to anchor the flexible chair spine 101 to the remainder of the chair 10. Flexible chair spine 101 and structural back support 102 support the back of user. The J-bar connector 113 and flexible chair spine 101 are designed such that when user 110 leans backwards with a sufficient force it flexes backwards. When the force is removed, J-bar connector 113 and flexible spine 101 return to their previous configuration. Flexible chair spine 101 may be made from materials such as thermoplastics, which can be bent, flexed, twisted, compressed, turned, and squeezed. Thermoplastic materials give flexible chair spine 101 an "elastic design." In this way, flexible chair spine 101 is capable of adjusting to the body of a user in a manner such that it follows the curvature of the user's back and spine.

Figure 2A:
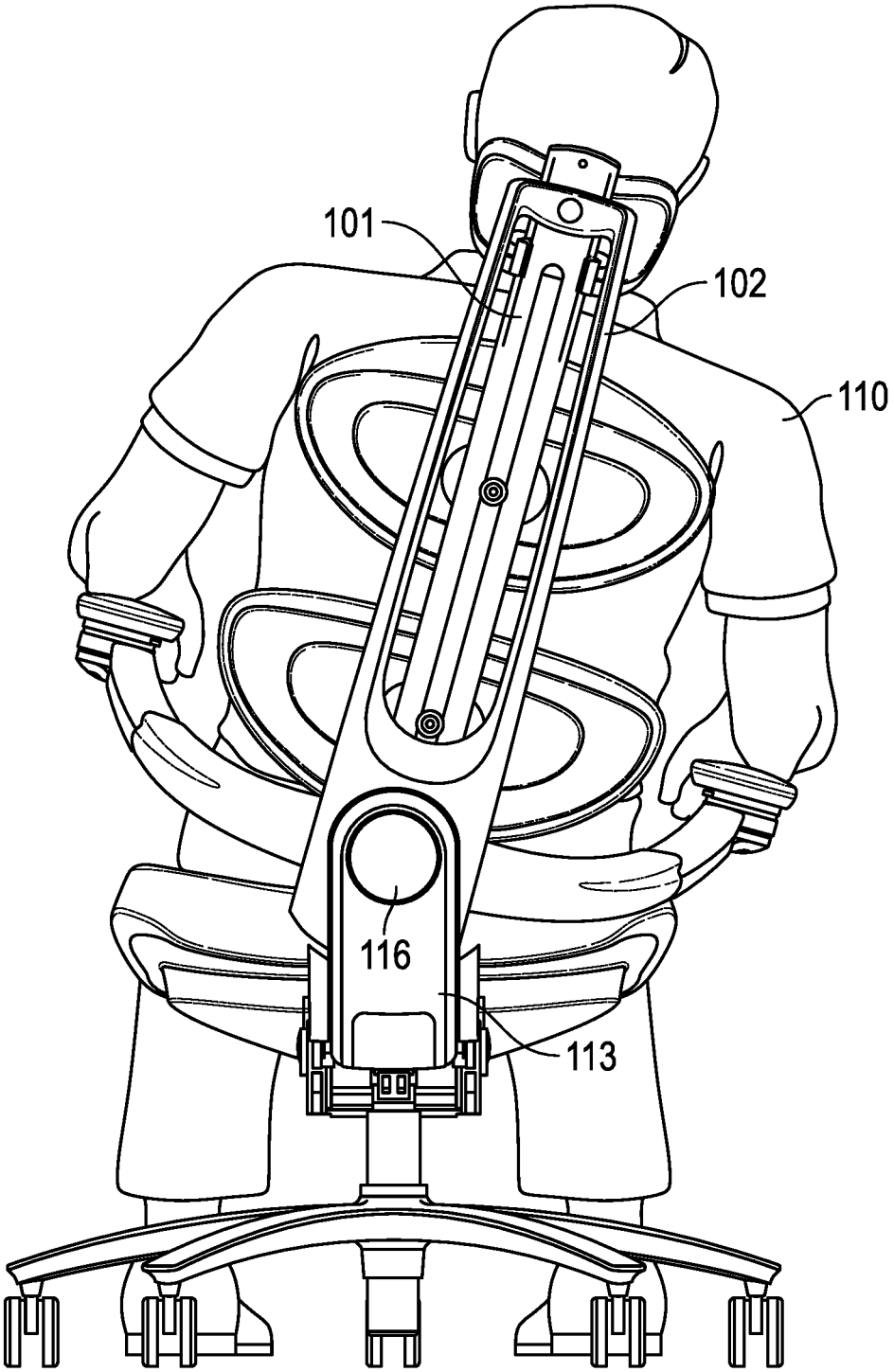
FIGS. 2A and 2B show a chair according to embodiments of the invention.
Figure 2B:
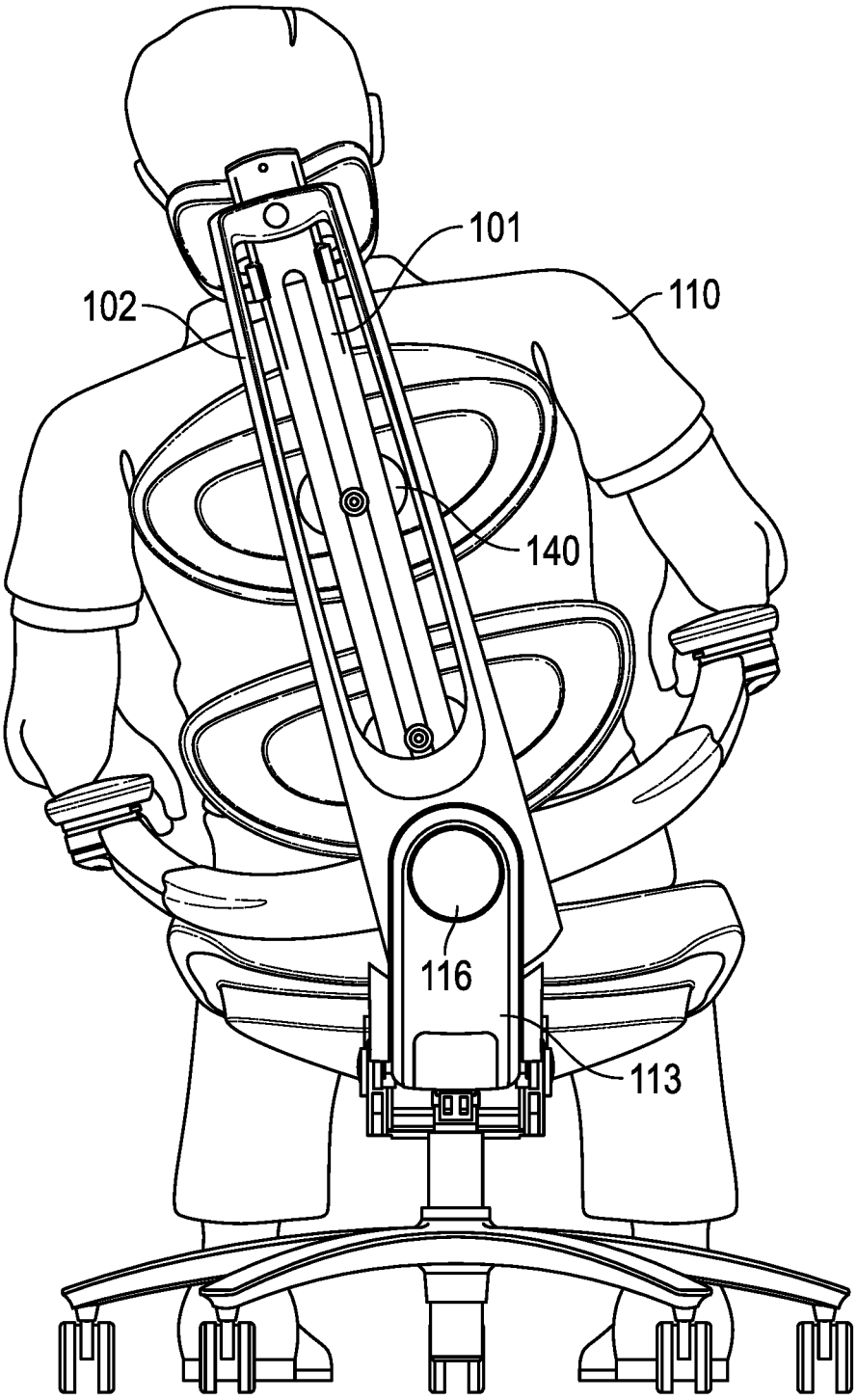
Figure 3A:
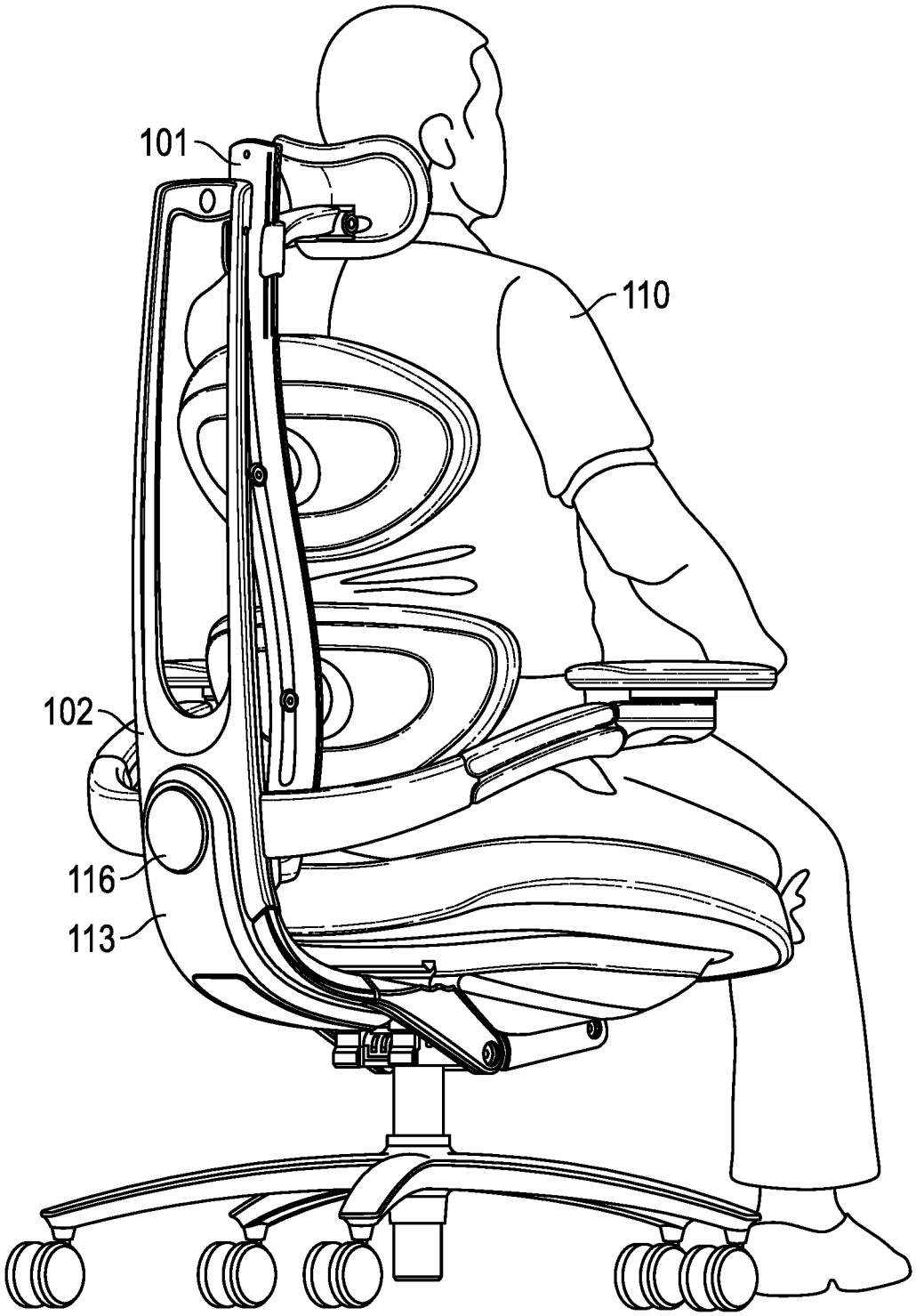
FIGS. 3A-3C show a chair according to embodiments of the invention.
Figure 3B:
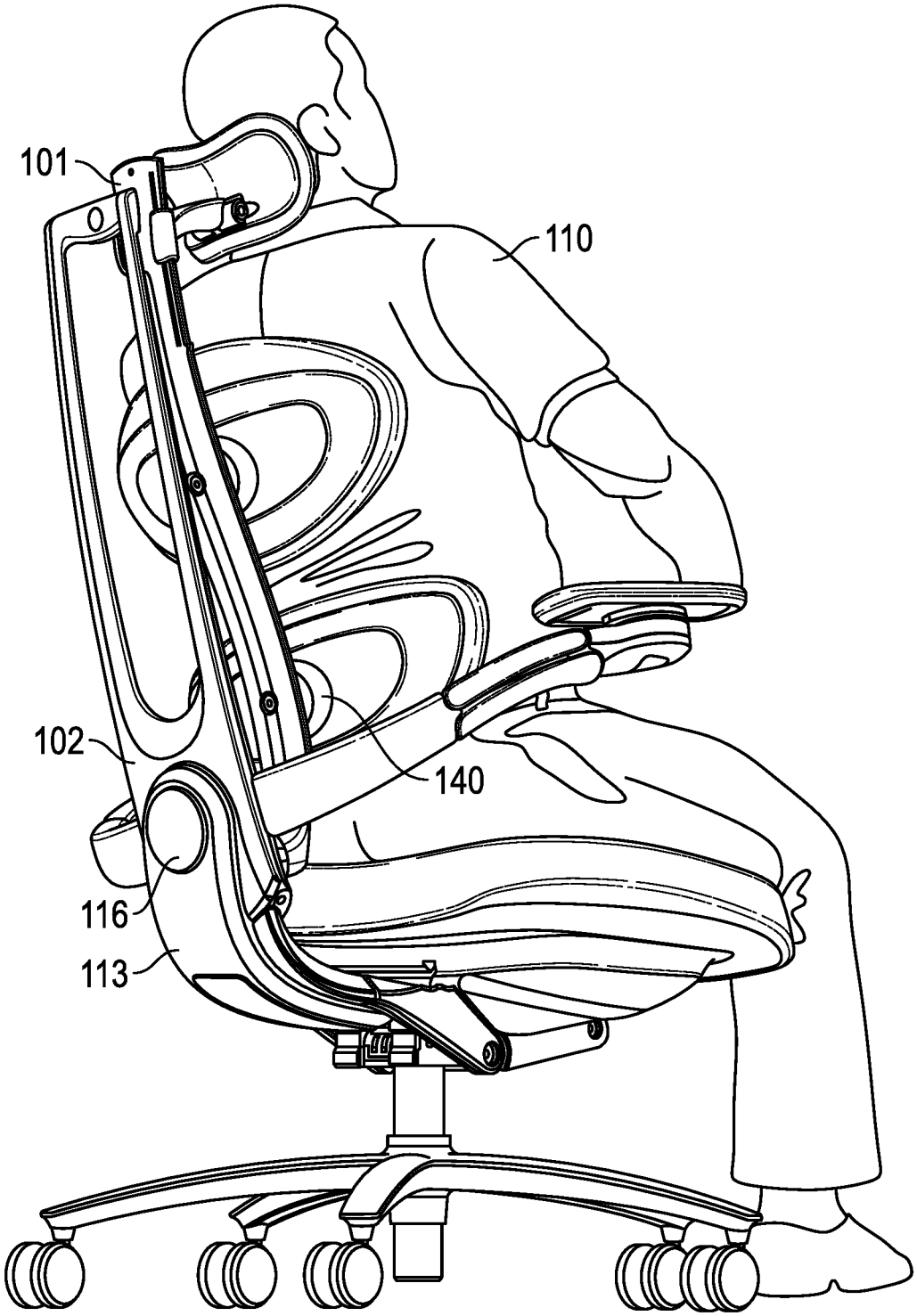
Figure 3C:
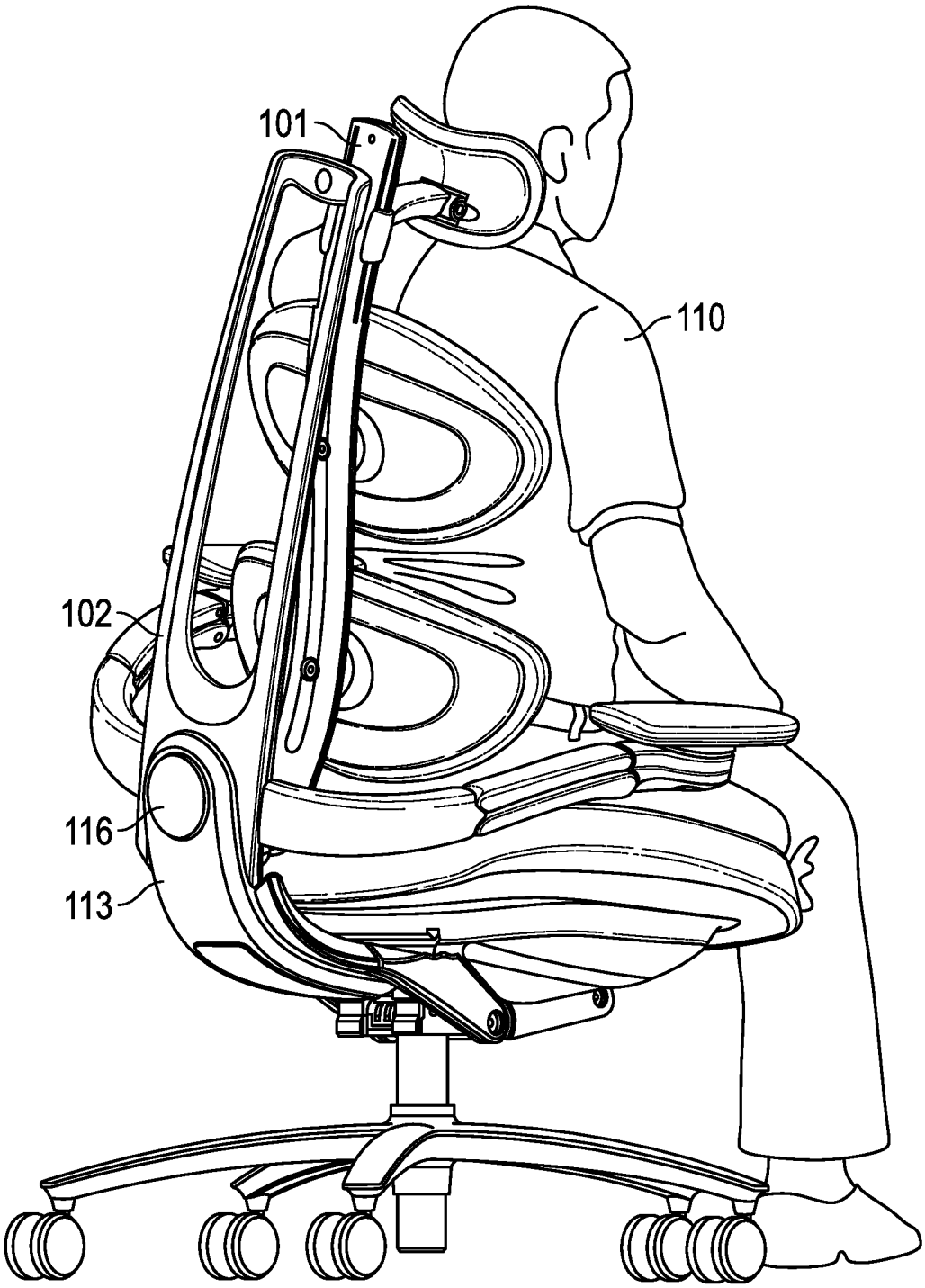

FIGS. 2A-2B (back view) and 3A-3C (perspective view) further illustrate the flexibility of the chair due to a mechanism that enables side to side or sidebending movement by a user 110 within a vertical plane that is aligned with the structural back support 102. FIG. 2A shows the structural back support 102 and flexible chair spine 101 moving to a right side of the user 110 within said vertical plane through a pivot point at a flexible connection mechanism 116, while FIG. 2B shows the structural back support 102 and flexible chair spine 101 moving to a left side of the user 110. FIG. 3A illustrates the user 110 in a starting or upright position where the structural back support 102 and flexible spine 101 are substantially in said vertical plane. FIG. 3B illustrates the structural back support 102 and flexible chair spine 101 moving from the left side of the user 110 through the pivot point at flexible connection mechanism 116, while FIG. 3C illustrates the structural back support 102 and flexible chair spine 101 moving to the right side of the user 110. The structural back support 102 and flexible chair spine 101 may return to the starting or upright position after completing the sidebending movements of FIGS. 2A-2B and 3B-3C. While these figures illustrate movements from an upright or starting position, the corresponding sidebending movements can occur in any position. The J-bar connector 113 remains substantially fixed throughout these movements of the user. These features enable the user 110 to accomplish exercises for the oblique muscles in the chair 10.

As shown in FIGS. 2A-3C, the flexible connection between the J-bar connector 113 and the structural back support 102, which will be further described herein, enable the chair 101 to move side to side with respect to the seat 12. The user 110 is free to move side to side through a sidebending range of motion. In one embodiment, the flexible connection mechanism 116 that connects the structural back support 102 and the J-bar connector 113 provides a pivot point for a sidebending range of motion. The bottom edge of the structural back support 102 is shaped like an arc of a circle and a middle portion of the J-bar connector 113 is shaped like a complementary portion of this arc. This complementary design enables the structural back support 102 to move from side to side without touching this middle portion of the J-bar connector 113. In some embodiments, the side to side range of motion of the user 110 is limited by the flexible connection mechanism 116. For example, the user 110 may only be able to move 15°-17° from center in each direction, enabling a full range of motion of 30°-34°. A locking mechanism that enables the user 110 to lock or unlock this feature of the chair 10 may be incorporated. In the locked position, the side to side range of motion is restricted and the structural back support 102 and the top portion of the J-bar connector 113 remain oriented in the same vertical position. This side to side feature may be enabled when user 110 desires to use the chair 10 to do the above described side to side exercises in addition to usual activities involving reaching, but may be disabled when user 110 desires to use the chair 10 for other purposes.

It should be noted that in prior art chairs a side to side motion of the upper body, as described above, is not available. If a user moved side to side, then the entire chair would move or the user would lose contact with the chair. Specifically, prior art back supports cannot independently move through a sidebending range of motion about a pivot point. In embodiments of the invention, however, chair back support 11 rotates side to side (right or left) without seat 12 rotating side to side (right or left). In this way, the resistance provided by back support 11 when sidebending by user 110's upper body, provides exercise to user 110's back, core, and oblique muscles. During the side to side motion of user 110's upper body, the agonist side of the body contracts and the antagonist side resists the motion back to a neutral position.

Figure 4A:
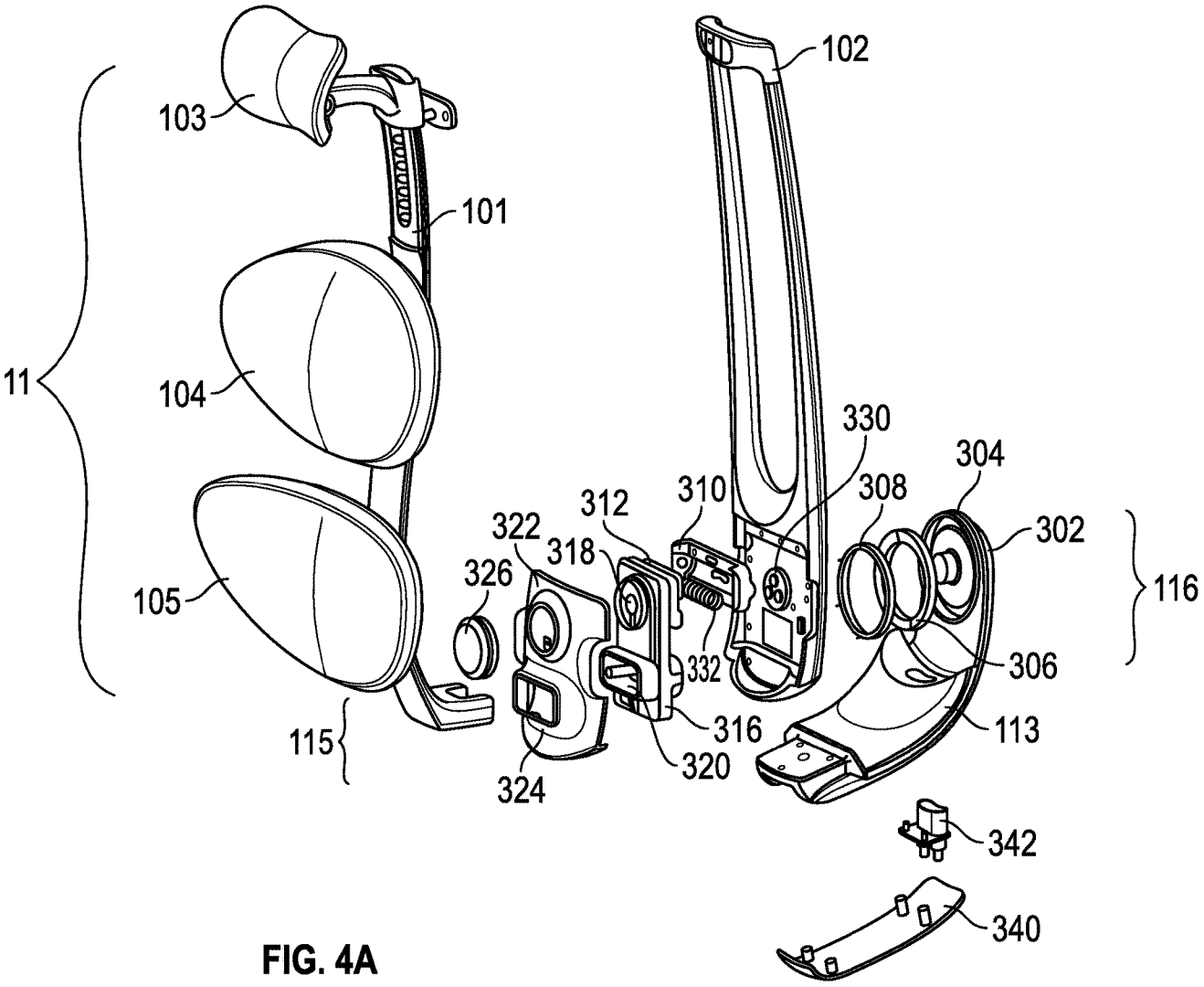
FIG. 4A shows an exploded view of a J-bar connector according to embodiments of the invention.
Figure 4B:
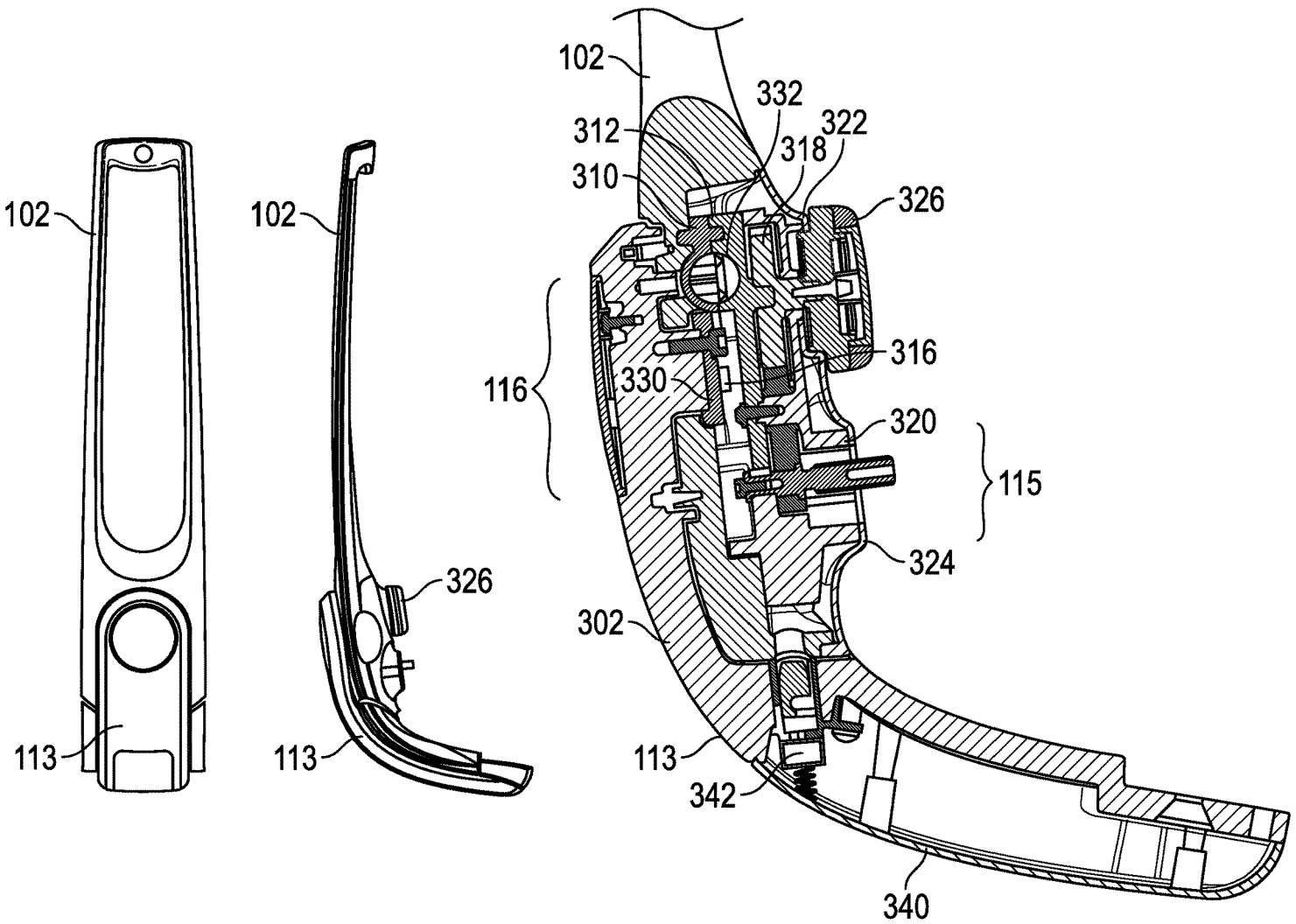
FIG. 4B shows a cross section view of the J-bar connector according to embodiments of the invention.

FIG. 4A illustrates an exploded view of the back support 11, which shows the flexible connection mechanism 116 of the chair 10 in greater detail. FIG. 4B illustrates a cross section view of the same portion of the back support 11. In this embodiment, the flexible chair spine 101 is mechanically connected to the structural back support 102 at a bottom portion through a first housing 320 in the J-bar connector 113 and at a top portion through a pivot point connection. These connections anchor the flexible chair spine 101 to the structural back support 102. The outer surface 302 of the J-bar connector 113 outlines a circular mechanical connection between the structural back support 102 and the J-bar connector 113. A circular housing 304 within the J-bar connector 113 houses two o-rings 306, 308 that provide a fit or barrier for the connection between the J-bar connector 113 and the structural back support 102. These o-rings 306, 308 may be made of a plastic or rubber material. A circular connector 330 on the structural back support 102 connects to the J-bar connector 113 within the circular housing 304. The connector 330 may include bolts or fasteners for attaching the structural back support 102 to the J-bar connector 113. This mechanical connection within circular housing 304 enables the structural back support 102 to rotate through a circular range of motion with respect to the J-bar connector 113 at this pivot point.

A spring housing 310, 312 that houses a spring 330 is connected to the structural back support 102. The spring 332 in this housing 310, 312 can provide resistance for the sidebending range of motion and/or cause the structural back support 102 to return to the neutral position after sidebending. Stationary or adjustable projections in the structural back support 102 or the circular housing 304 may be used to impede or stop the movement of the structural back support 102, which can limit the range of motion and give a soft end feel. A first connector 316, which includes a portion of the spring housing 312, mechanically connects to the structural back support 102. A fitted casing 322 is adjacent to the first connector 316. The first connector 316 includes a first housing 320 that is designed to mechanically connect to the flexible chair spine 101 through connection 115, and a second housing 318 that is designed to mechanically connect to a button 326. The fitted casing 322 assists with (1) the connection 115 between the flexible chair spine 101 and the first connector 316, and (2) the connection between the button 326 and the first connector 316. This button 326 may be used to adjust the settings for the back support 11.

In another embodiment, button 326 or another button or knob may be used to control or adjust the sidebending range of motion for the structural back support 102. Specifically, actuation of a button or knob may (1) lock the flexible connection mechanism 116, thereby preventing the structural back support 102 from moving through a sidebending range of motion, or (2) adjust the range of motion or resistance for the flexible connection mechanism 116. This enables the user 110 to control the range of motion and/or resistance associated with the side to side motion of the back support 11.

In one embodiment, button 326 or another button or knob may be used to control or adjust the shape and/or resistance of the flexible chair spine 101. Specifically, the actuation of a button or knob could adjust the position of the flexible chair spine 101 with respect to the structural back support 102 by moving this portion of the spine 101 forward or backward. This movement would adjust the elasticity or resistance of the spine 101 through multiple settings aiding in customizing the fit to the individual user. In another embodiment, a separate knob or button on the J-bar connector 113, the structural back support 102, or the seat surface 106 may be actuated to reduce tension in flexible chair spine 101 and/or increase the tension, or vice versa. This knob or button may control the shape of the flexible chair spine 101, thereby controlling the tension therein. In other embodiments, the knob may also operate a pulley system to change the tension in wires that run throughout the flexible chair spine, and could, for example, provide multiple resistance levels.

A second connector 342 may be designed to further support the adjustable connection 115 between the flexible chair spine 101 and the J-bar connector 113. The second connector 342 may be spring loaded to assist in adjusting the shape and/or resistance of the flexible chair spine 101. An outer casing 340 may be used to cover the second connector 342 and the bottom side of the J-bar connector 113.

FIGS. 4A-B illustrate one embodiment of the current invention and are not designed to limit the current invention to this embodiment. The flexible connection mechanism 116 between the structural back support 102 and the seat 12 could be designed differently to achieve the sidebending range of motion for the user or provide for a different side to side range of motion. Similarly, the connection 115 between the flexible chair spine 101 and the structural back support 102 could be designed differently to achieve an adjustable shape or resistance of the flexible chair spine 101.

Figure 5A:
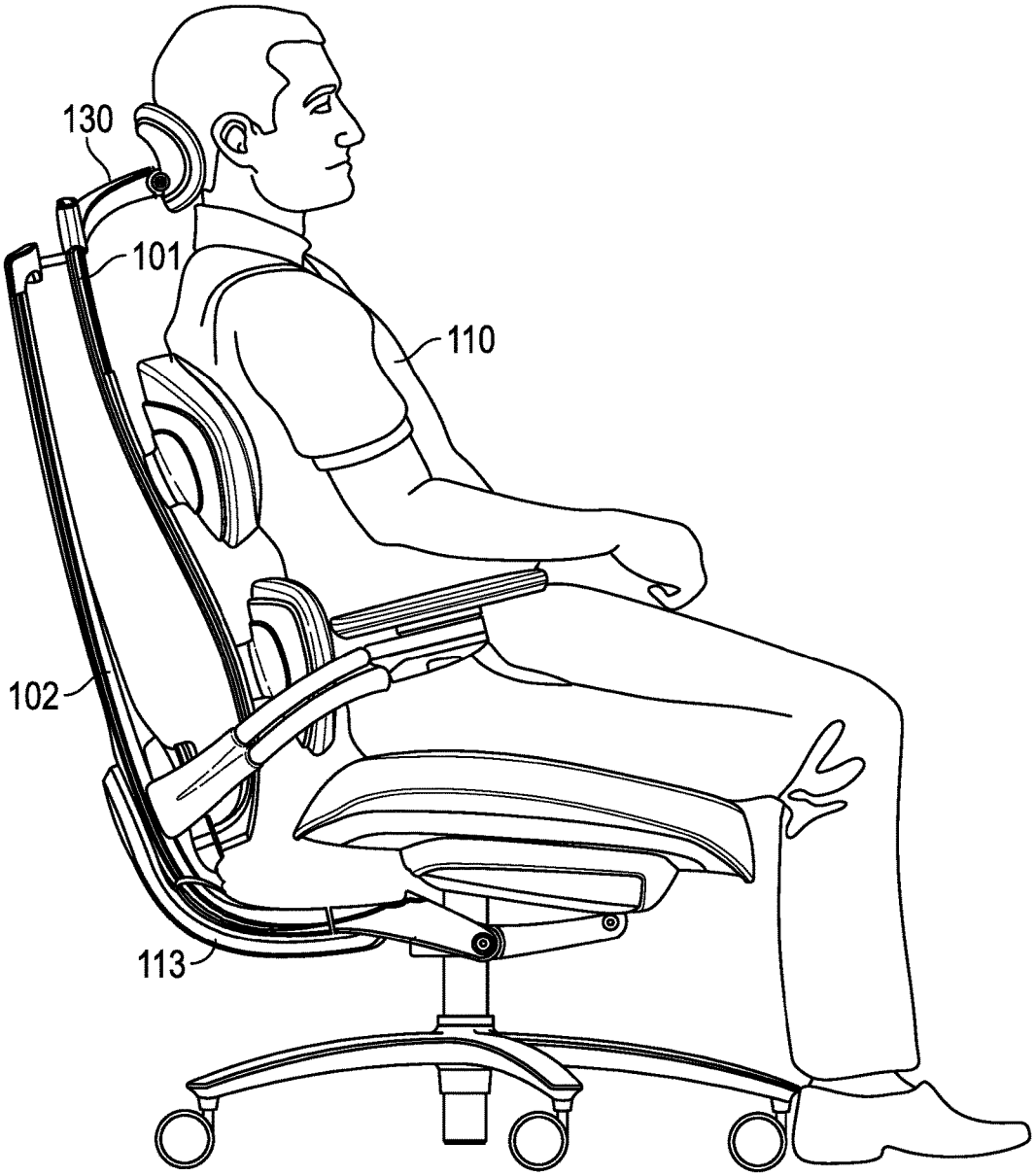
FIGS. 5A-5B show a chair according to embodiments of the invention.
Figure 5B:
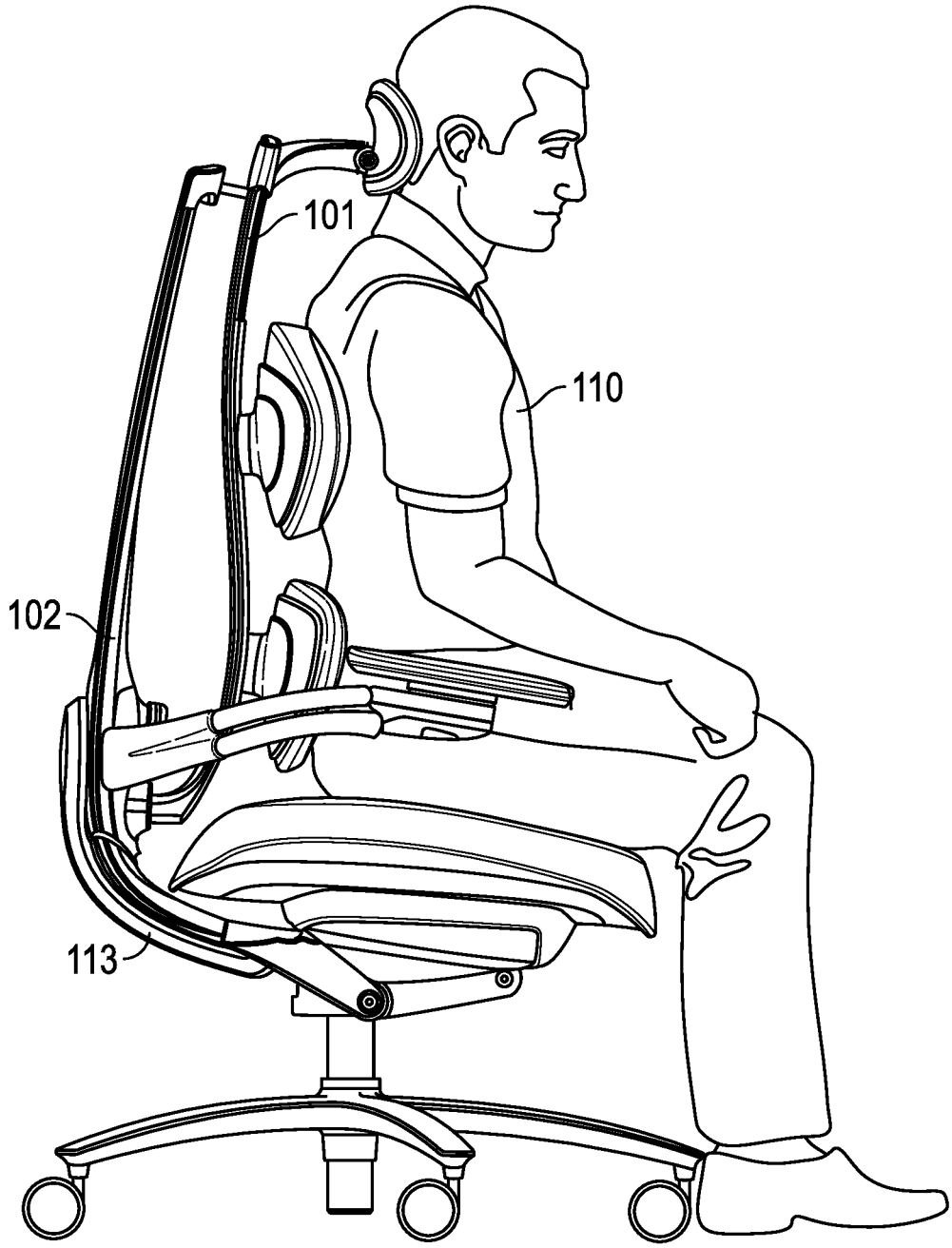

FIGS. 5A and 5B illustrate chair 10 adapting to accommodate different seating postures of user 110. In FIG. 5A, user 110 adopts a reclining position by leaning backwards with sufficient force so as to cause flexible chair spine 101 in conjunction with the J-bar connector 113 to bend backwards as shown. Chair 10 compensates for user 110's reclining posture. Specifically, chair back support 11 includes flexible chair spine 101, which adapts to user 110's spine curvature while also providing sufficient support to prop user 110 up and give proper support to user 110's spine. It should be noted that user 110's spine is slightly bent and flexible chair spine 101 and the J-bar connector 113 adapts to that slightly bent configuration. In other words, flexible chair spine 101 not only supports user 110's back, it also conforms to the shape of user 110's back and keeps user 110's body upright. In this way, flexible chair spine 101 is configured to bend to the curvature of user 110's spine but remains stiff enough to support user 110's back.

FIG. 5B shows chair 10 adapting to user 110's posture when user 110 leans forward. It should be noted that in FIG. 5B, user 110's spine is relatively straight and spine 101 adopts to this relatively straight neutral configuration.

If user 110 moves from the posture shown in FIG. 5A to the posture shown in FIG. 5B, i.e. user 110 leans forward, spine 101 will compress (overall) and the flexible spine 101 will adjust accordingly. The converse is true—if user 110 moves from the posture shown in FIG. 5B to the posture shown in FIG. 5A, i.e. user 110 leans backward, spine 101 will expand (overall). Thus, instead of a chair that is basically fixed and the user's body taking a posture that conflicts with the chair design (such as the chair back), as is the case with existing chairs, chair 10 conforms to user 110's posture. In other words, flexible chair spine 101, in conjunction with the J-bar connector 113, bends by flexing and compressing depending on the change in the shape of, and force applied by, a user's back on chair back support 11 of chair 10. This compression of spine 101 provides an exercise function allowing the user 110 to practice core stabilization exercises such as pelvic tilt.

It should be appreciated that, in most existing chairs, when the user leans backward, the back portion of such chairs do not bend. Instead, there may be a pivoting mechanism at or below the seat level that allows the chair back as a whole to move backwards without the chair back itself bending. In other words, no portion of the back of such chairs move significantly, if at all, in relation to another part of the back or in relation to the seat. In contrast, as in FIGS. 5A and 5B, the shape of flexible chair spine 101 changes depending on the position and shape of the back of user 110. In this way, portions of flexible chair spine 101 move in relation to other portions of spine 101. Thus, the additional bending or flexing of back support 11 or flexible spine 101 as described herein is different from the simple tilting or pivoting of the back support as happens with existing chairs. The bending or flexing flexible spine 101 includes an outer section stretching and a corresponding inner section compressing. It should also be noted that the bending occurs at a level higher than a level of the seat and is not solely based upon a lumbar adjustment, as typical in current offerings. This bending is different from mechanisms at the base of back support 11, such as the J-bar connector 113, that allows movement, such as tilting, of back support 11. The flexible spine 101 in conjunction with the J-bar connector 113 enable the chair 10 to recline up to 35°, which is further than existing chairs.

User 110 may move from the posture shown in FIG. 5A to the posture shown in FIG. 5B, or vice versa (back support 11 and flexible spine 101 bending backwards and forwards) several times in a day. Because flexible chair spine 101, and in some embodiments J-bar connector 113, have a resistance mechanism, user 110's back and forth movement allows user 110 to exercise his or her lower core throughout the day. While doing this back and forth movement, the more resistance applied to the chair, the easier the exercise becomes, as the chair assists with this movement. As such, flexible chair spine 101, helps to strengthen user 110's core by virtue of the chair 10's flexibility that at the same time provides a predetermined resistance to movement. Muscles such as the abdominals, erector spinae and quadratus lumborum (iliocostalis, spinalis, longiissimus) are strengthened by these exercises. The erector spinae and quadratus lumborum muscles help maintain proper alignment of the spine. Weakness in these muscles leads to poor posture and back pain. These conditions may be prevented when a user uses chair 10 to exercise. Other muscle groups that are exercised as user 110 moves against the resistive force of flexible chair spine 101 include rectus abdominis, external and internal oblique's psoas, diaphragm, pelvic floor, hips, shoulders, and paracervicle muscles.

Neck support 103, thoracic support 104, and lumbosacral support 105 will move with the user's body during the use of chair 10. As the user flexes, extends or rotates his or her body in chair 10, each of neck support 103, thoracic support 104, and lumbosacral support 105, which support the three primary regions of the spine, will move in conjunction with a corresponding body part (head and sections of back). This provides support to and lower pressure on all of the spinal segments. For example, when the user's spine twists, each of the supports 104, 105 may twist individually, allowing for up and down movements at any angle. Further, it provides exercise for muscles along the full length of the three muscle groups of the spine as well as the intrinsic muscles between individual vertebra.

Figure 6A:
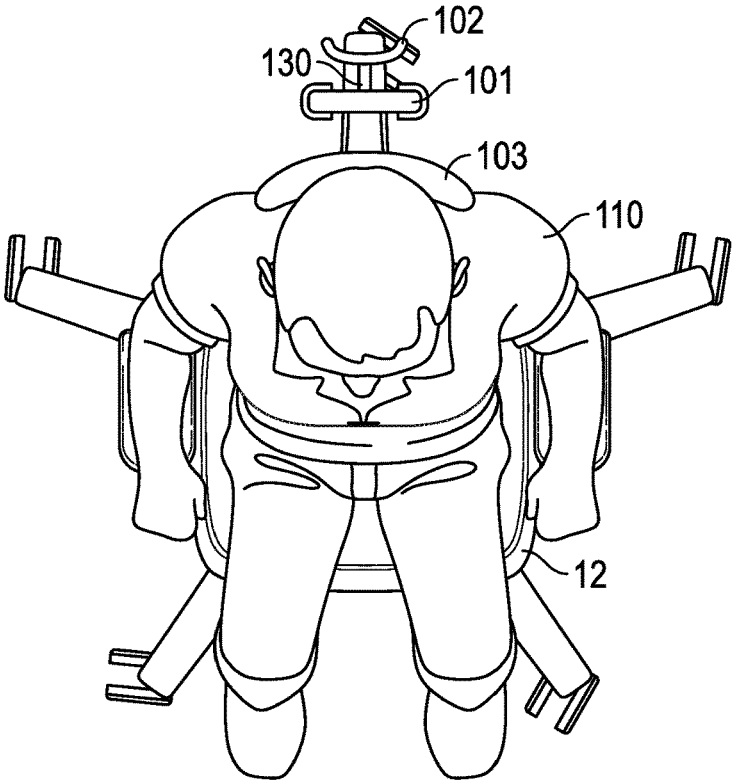
FIGS. 6A-6C show a chair according to embodiments of the invention.
Figure 6B:
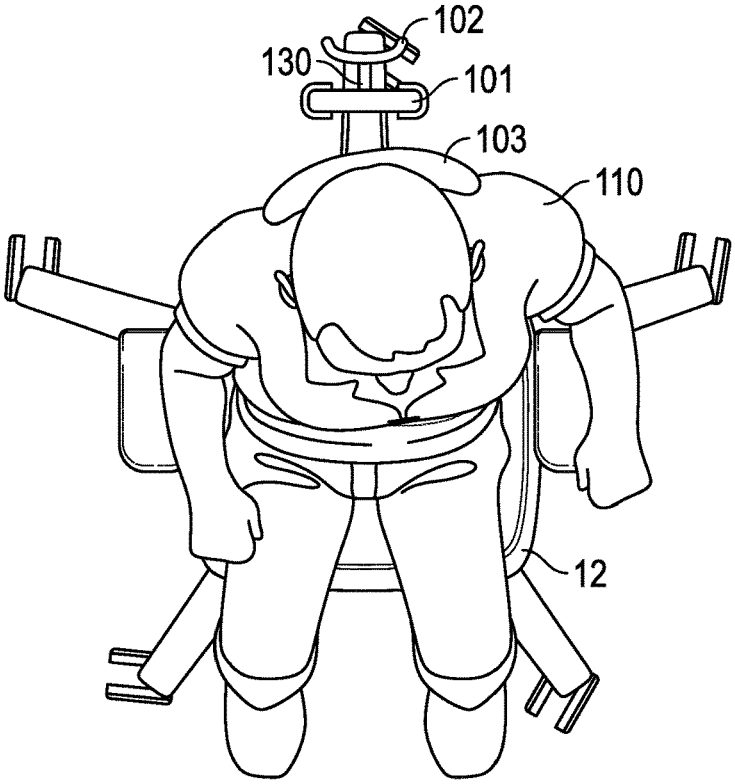
Figure 6C:
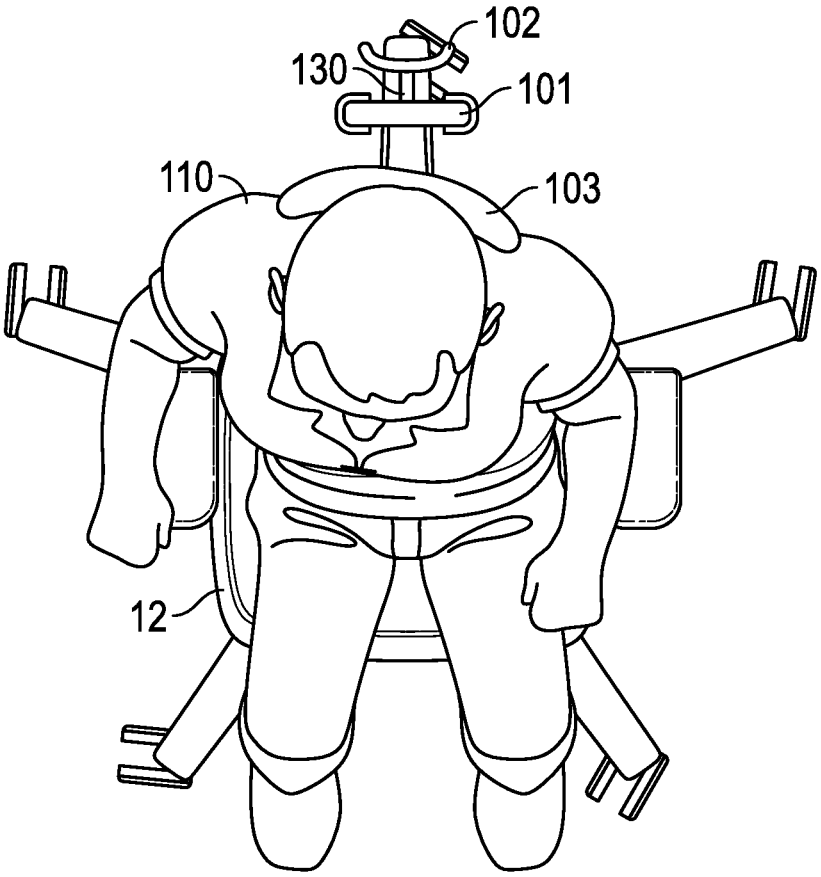

In embodiments, the flexibility in flexible chair spine 101 is not only with respect to (1) side to side movement as depicted in FIGS. 2A-3C, and (2) backwards and forwards movement as depicted in FIGS. 5A and 5B. Rather, as shown in FIGS. 6A-6C, flexible chair spine 101 may also be flexible so as to allow user 110 to rotate left to right when seated in chair 10. In other words, user 110 can turn clockwise and counterclockwise, pivoting from the hip so that flexible chair spine 101 flexes (rotates) as the back of user 110, while resting on flexible chair spine 101 and the connections of the lumbosacral 105 and thoracic supports 104, is rotated (twisted) to the left or right. In this way, chair back support 11 has sufficient flexibility in flexible chair spine 101 to provide a mechanism for user 110 to exercise back, core and surrounding muscles by rotating (twisting) the upper body from left to right, pivoting from the hip, as shown in FIGS. 6A-6C. This exercise feature is in addition to or an alternative to the exercise feature provided by the side to side movement described in FIGS. 2A-3C and the backwards and forwards movement described in FIGS. 5A and 5B.

It should be noted that in existing chairs a left to right twisting (rotating) motion of the upper body, as described above, would cause the seat and/or chair back to rotate together in the direction of the rotating motion. This is the swiveling motion of existing chairs. In embodiments of the invention, the swiveling feature may be present but there also may be mechanisms to make it inactive when user 110 desires to use flexible spine 101 to do the above described rotation exercises. In embodiments of the invention, structural back support 102 remains stable as flexible chair spine 101 pivots (rotates) at connection 115 and lumbosacral support 105 and thoracic support 104 rotate on flexible chair spine 101 at their respective connection points. In this way, the resistance provided by flexible chair spine 101 when it is being rotated by user 110's upper body, provides exercise to user 110's back and core muscles. During the rotation motion of user 110's upper body, the agonist side of the body contracts and antagonist side resists the motion back to a neutral position.

Figures 7A, 7B:
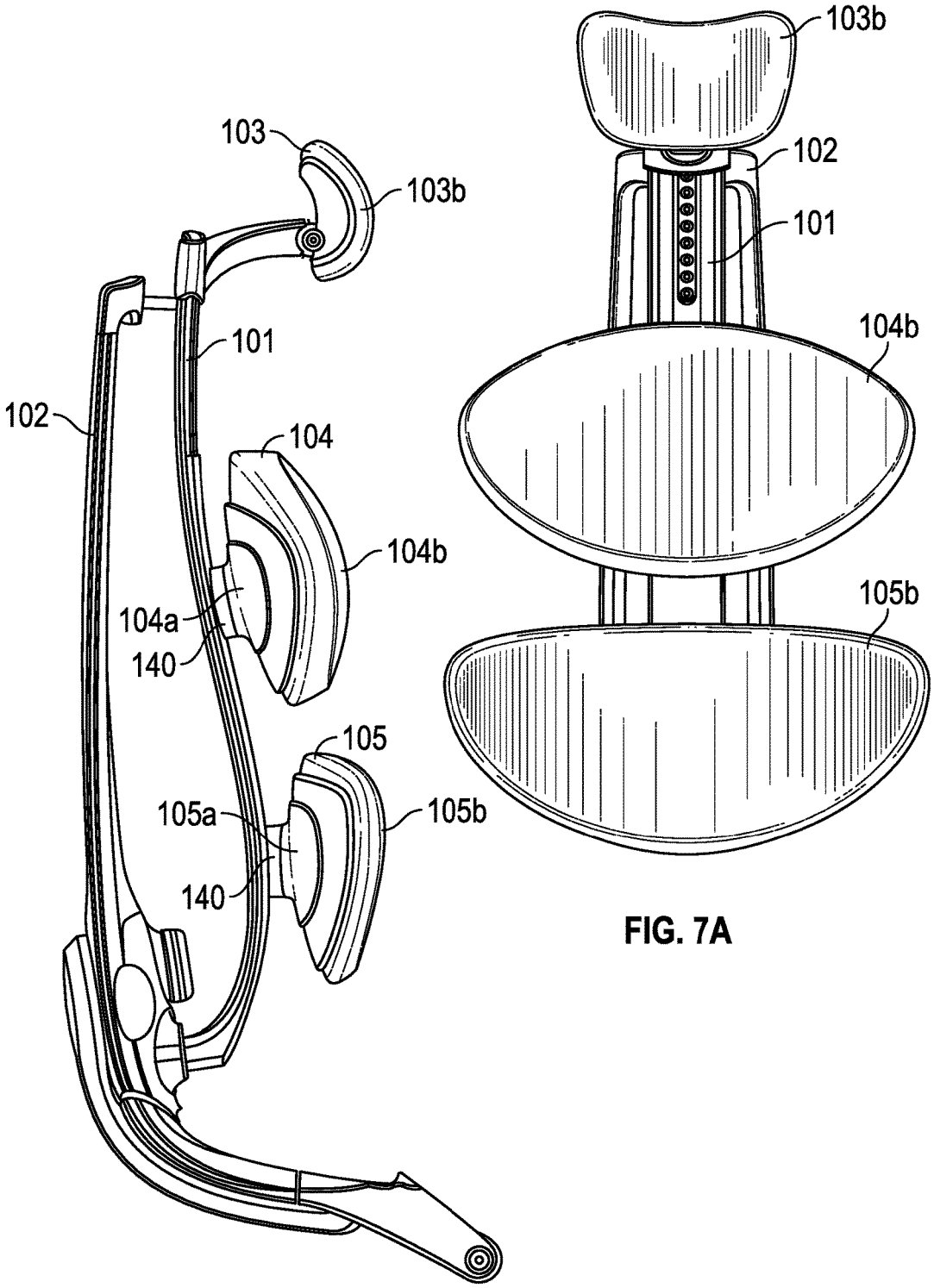
FIGS. 7A and 7B show a back support according to embodiments of the invention.

FIGS. 7A and 7B illustrate the back support 11 according to certain embodiments of the invention. Thoracic support 104 is configured so that it molds to a user's body and promotes proper posture when the user sits in chair 10. The outer portion of thoracic support 104 may include a flexible back 104*a* (e.g. made of flexible plastic, memory foam and lycra) with an inner layer 104*b* that contacts the thoracic area of user 110 when user 110 is seated in chair 10. Flexible back 104*a* may be connected to flexible spine 101 through a circular connector 140, which can be attached to the flexible spine 101 by various means including a screw or a bolt. The circular connector 140 may be made of a rubber or plastic material that promotes flexibility. Inner layer 104*b* may be made of non-metallic materials, including but not limited to, egg crate memory foam, nylon covering, gel, and the like. Inner layer 104*b* may be connected to flexible back 104*a* by adhesives such as glue or by mechanical means such as screws. Further, inner layer 104*b* may be adapted to conform to a user's body. In this way, when user 110 sits in chair 10, thoracic support 104 will expand to the shape of user 110's upper back. This strengthens the user's core (stomach, hips and lower back). The inner layer 104*b* forms a convex surface with respect to the user, which pushes against this portion of the user's spine 110 to promote proper posture and provides pressure relief to the scapulae to allow freedom for upper extremity movement. The thoracic support 104 is flexibly connected to flexible spine 101, so that it may flex or twist independently.

Lumbosacral support 105 is configured so that it molds to a user's body and promotes proper posture when the user sits in chair 10. The outer portion of lumbosacral support 105 may include a flexible back 105*a* (e.g. made of flexible plastic, or thermoplastics) with an inner layer 105*b* that contacts the lower back area of user 110 when user 110 is seated in chair 10. Flexible back 105*a* may be connected to flexible spine 101 through a circular connector 140, which can be attached to the flexible spine 101 by various means including a screw or a bolt. The circular connector 140 may be made of a rubber or plastic material that promotes flexibility. Inner layer 105*b* may be made of non-metallic materials, including but not limited to, egg crate memory foam, nylon covering, gel and the like. Inner layer 105*b* may be connected to flexible back 105*a* by adhesives such as glue, or by using mechanical means such as screws. Inner layer 105*b* may be made of material adapted to conform to a user's body. In this way, when user 110 sits in chair 10, lower back support 105 will expand to the shape of user 110's lower back. This strengthens the user's core (stomach, hips, and lower back). The inner layer 105*b* forms a concave surface with respect to the user, which comforts this portion of the user's spine to promote proper posture. The lumbosacral support 105 is flexibly connected to flexible spine 101, so that it may flex or twist independently and is oriented in such a way to promote an anterior pelvic tilt.

In certain embodiments, the shape and contour of thoracic support 104 and lumbosacral support 105 promote proper posture. While both supports 104, 105 resemble an oval shape, thoracic support 104 has more height and less width than lumbosacral support 105. Further, the convex surface of thoracic support 104 contrasts the concave surface of lumbosacral support 105. These desired shapes and contours and placement on the flexible chair spine 101 of the thoracic support 104 and lumbosacral support 105 promote proper posture and support for the user's spine.

Lumbosacral support 105 and thoracic support 104 may also be made of memory plastic that molds to user 110's body when user 110 sits into chair 10. The memory plastic material is adapted to expand and contract. It contracts when user 110 sits in chair 10 and expands when user 110 gets out of chair 10. It should be noted that neck support 103 (if included), thoracic support 104, and lower back support 105 may be provided as one element attached to flexible chair spine 101 instead of the separate elements attached to flexible chair spine 101 as shown. It should also be noted that chair back support 11 could be one contiguous element (including sections covered by neck support 103, thoracic support 104, and lumbosacral support 105) that is flexible as described with respect to flexible spine 101.

FIGS. 1A-1C show chair 10 also includes arm supports 114. Arm supports 114 provide support for user 110 to rest his or her arms on. Arm supports 114 may be substantially horizontal in a plane above seat 12 (at a higher level) and to the left or right of seat 12. Arm support 114 may include memory arm pad 111 to relieve pressure on user 110's forearm. This is an ergonomic feature. When user 110 rests his or her arm on arm pad 111, arm pad 111 relieves pressure points on user 110's arm and promotes healthy circulation in the arms. The end of arm pad 111 may have a notch/grip for user 110 to hold during exercises. The notch/grip may also be used as a stabilization point for stretching to relieve/prevent carpal tunnel, golfer elbow, and tennis elbow. In some instances, arm supports 114 may prevent user 110 from pulling chair 10 as close to a desk as user 110 may desire. To equip arm supports 114 with the flexibility of providing proper ergonomic support and allow chair 10 to be pulled close to a desk without hindrance from arm supports 114, arm supports 114 may be adapted so that their positions can be changed in relation to the other components of chair 10. In some embodiments, a button or knob 112 is located on the bottom side of each arm pad 111 to allow the user to adjust the positions of the arm supports 114. Since a button or knob 112 is located under each arm pad 111, the arm supports 114 may be adjusted independently of one another. The arm supports 114 are adjustable forward/back, in/out, and rotate 360 degrees. The arm supports 114 may be anchored to the structural back support 102 and/or flexible chair spine 101 to enhance the flexibility or movement of the arm supports 114 during exercises by the user 110.

Figure 8A:
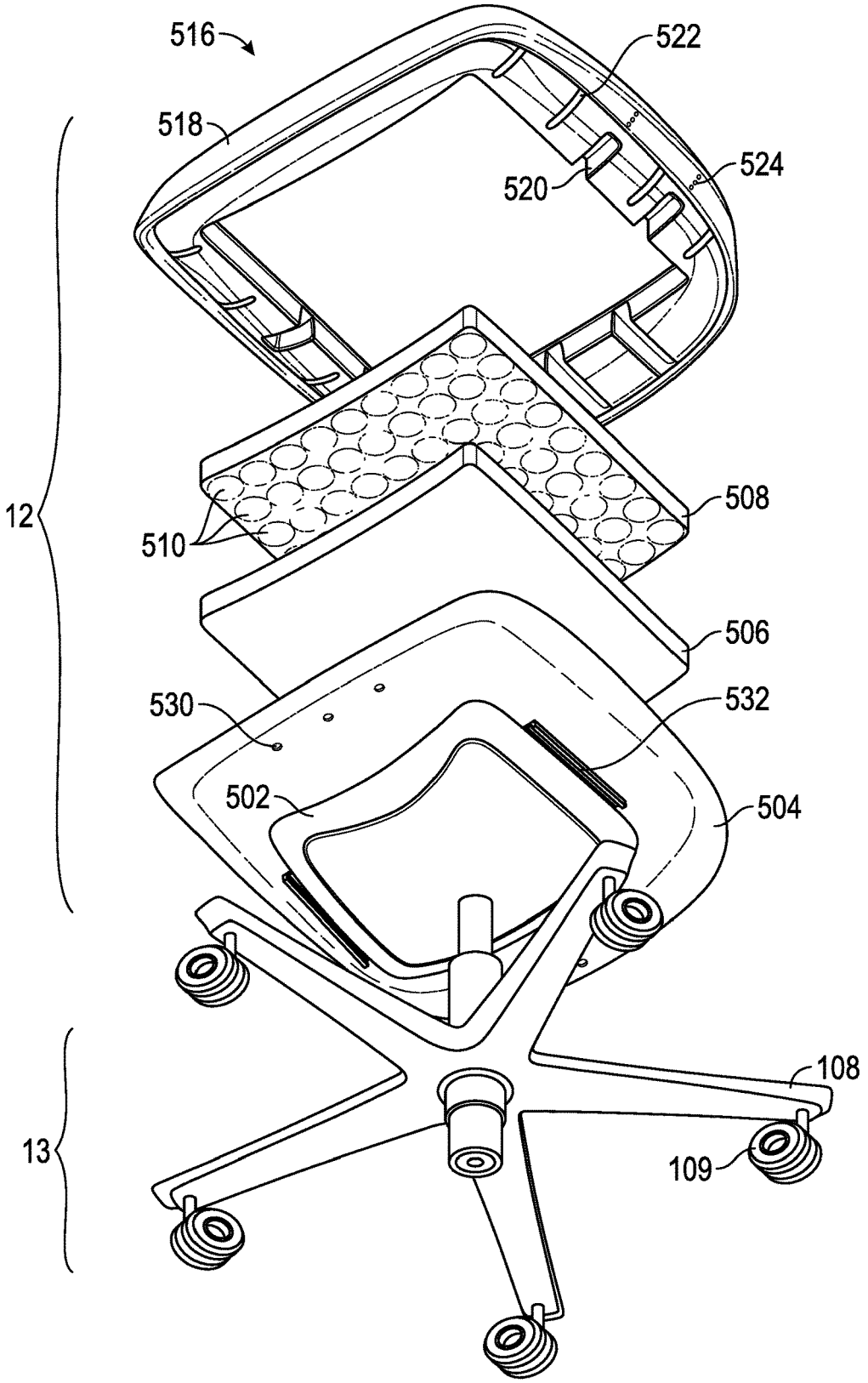
FIGS. 8A-8C show a seat according to embodiments of the invention.

FIGS. 1A and 1B show chair 10 including seat 12. Seat 12 may be made of materials including memory foam, gel, and nylon elastic outer fabric. Seat 12 may be connected to chair back support 11 by, for example, the J-bar connector 113. However, different methods may be used to connect seat 12 to chair back support 11. FIG. 8A illustrates an exploded view of seat 12. The seat 12 may be connected to the base 13 by various methods. The base 13 may be a five-star base with five arms 108, wherein each arm 108 is connected to a wheel 109.

In certain embodiments, the seat 12 comprises a seat pan 504 (made of plastic, metal, the like or combinations thereof) that may be attached to a pedestal 502 (made of plastic, metal, the like or combinations thereof) by fasteners, bolts, glue, etc. In some embodiments, the seat pan 504 connects to the pedestal 502 through an adjustable track system 532, where the seat pan 504 may slide forward and backward with respect to the pedestal 502. This feature enables the user to adjust the position of the seat 12 with respect to the back support 11. The pedestal 502 may be connected to the base 13 by various methods. The seat pan 504, which is designed to house the cushion or foam layers of the seat, forms the bottom shell of the seat 12. A first layer 506 may be made of materials including but not limited to egg crate memory foam, nylon covering, gel and the like. This first layer 506 is housed at the bottom of the seat pan 504. A second spring layer 508 that houses numerous springs 510 is stacked on top of the first layer 506 in the seat pan 504. The spring layer 508 relieves pressure on bony prominences of the user 110. These layers 506, 508 provide comfort and support to the user 110. Varying foam densities may be used in these layers 506, 508, to relieve pressure in bony prominences in the tailbone and at the base of the spine of the user 110 and to promote positioning and circulation.

A seat surface 516 contacts the user 110 when seated in the chair 10. The seat surface 516 is designed to be mechanically connected to the seat pan 504 through various methods, including fasteners, clips, bolts, form fitting, etc. When connected, the seat surface 516 and the seat pan 504 create a shell or interior housing for the three layers 506, 508 of the seat 12. As shown in FIG. 8A, the seat surface 516 includes a housing for a portion of the three layers 506, 508 to fit into. An outer layer 518 that covers the outside of seat surface 516 may be made of materials including but not limited to leather, breathable fabric, nylon covering, and the like. The seat surface 516 contains holes or vents 522 to connect the seat surface 516 to the seat pan 504 through the use of clips, screws, bolts, etc. In some embodiments, the holes 522 provide a hollow area for the seat pan 504 to clip to the seat surface 516. The seat surface 516 includes channels 520 which provide an open-air tunnel between the three layers 506, 508 and the outer layer 518 of the seat surface 516. Vents or holes 524 in the outer layer 518 are provided at the locations of the channels 520. The channels 520 and the vents 524 provide an open-air connection between the interior housing with the two layers 506, 508 and the outside environment, which is designed to promote air circulation in the seat 10. Thus, air can flow into and out of the interior housing of the seat 12, thereby cooling the seat. Porous materials may be used for the first layer 506 and the spring layer 508 to further promote air circulation in the seat 12. The seat pan 504 also contains holes 530 and the adjustable track system 532, which is open to the exterior, to promote air circulation between the interior housing with the two layers 506, 508 and the outside environment. In combination, these features create a breathable seat for the user.

Figure 8C:
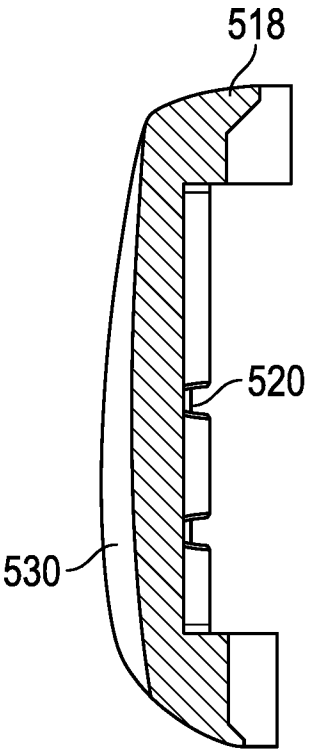
Figure 8B:
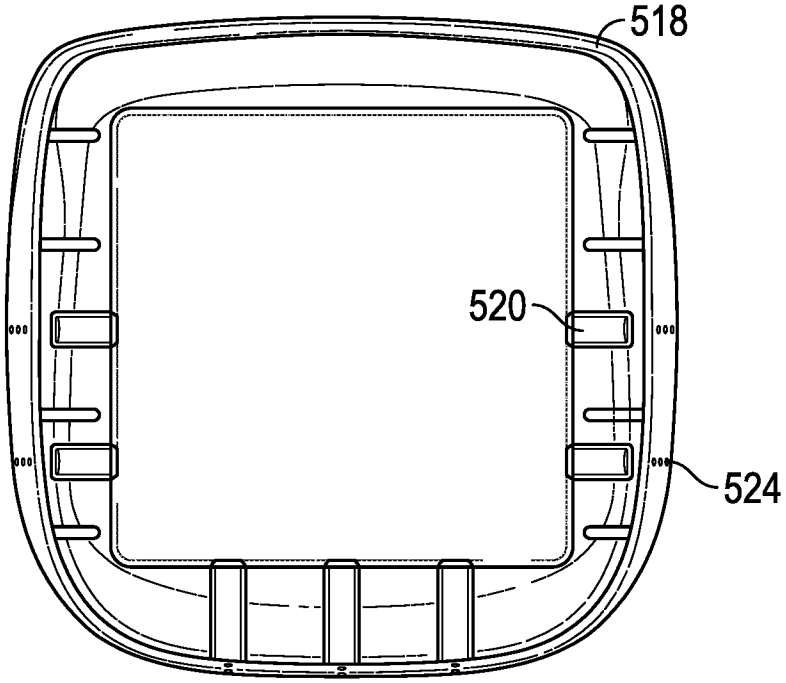

FIGS. 8B and 8C illustrate a bottom view and a side view of the seat surface 516. The outer layer 518 includes vents or holes 524 that align with the channels 520 in the seat surface 516. These features create the open air tunnel between the inner layers 506, 508 and the outside environment. A top portion 530 of the seat surface 516, which contacts the user 110, is contoured to the shape of the user's legs and buttocks. The top portion 530 of the seat surface 516 may also include a waterfall edge at the front portion of the seat 12 (away from chair back support 110) which promotes healthy blood circulation in user 110's body. A wedge seat that tilts downward toward the seat (forward tilt) may be incorporated to promote anterior pelvic tilt and open up the hip angle, thereby promoting proper postural alignment from the base of support and creating more room for blood circulation and nerves. Overall, the combinations of the features of the seat 12 provide user 110 with an ergonomic seat.

While the inherent ergonomic features of the chair promote an active lifestyle and proper posture, additional technical improvements further enhance the user's experience by providing feedback on the user's posture or workout program. In certain embodiments, the chair 12 is also equipped with sensors to (1) provide feedback to the user about his or her posture and form/technique while exercising, and/or (2) track the number of repititions completed for any of the exercises described above. Pressure sensors may be placed under the outer layer 518 of the seat surface 516 to track the user's location on the seat. Additional pressure sensors may be placed under the surface of the lumbosacral support 105 and/or the thoracic support 104 to track the user's alignment when seated in the chair 12. Based upon the desired configuration, on/off sensors or analog sensors that track various pressures may be used.

Pressure readings from these sensors could be transmitted to a computing device on the chair for tracking, aggregation, and analysis. These readings could be analyzed to determine whether the user 110 is pushing too hard against certain portions of the chair or if there is no pressure being applied in an area where there should be. Data from the computing device could then be transmitted to a computer or server for further processing. In another embodiment, the pressure readings from the sensors could be transmitted directly to a computer, smartphone, wearable device, or server for tracking, aggregation, and analysis. From there, the results could be presented to the user through a user interface or application on a computer, smartphone, or wearable device. For example, a user could obtain an analysis or summary of his posture through the day through a smartphone application. The application may act as a "posture coach" by recommending solutions to improve the user's posture and/or signal an alarm to the user if his or her posture is failing. This data may also be used for social media interactions, research, or shared with insurance companies or medical professionals with consent of the user 110. If this information is shared with insurance companies or medical professionals, then proper user identity protection precautions must be designed and adhered to.

Additional sensors could be placed on or in the structural back support 102 or the J-bar connector 113 to track the movement of the structural back support 102. For example, one or more sensors in the J-bar connector 113 may track the number of times that the user moves from side to side or forward and back to complete an abdominal exercise. This feature could be used to track the number of repetitions for the user's abdominal workout. These readings could also be transmitted directly to a computer, smartphone, wearable device, or server for ultimate presentation to the user.

Embodiments of the invention include methods that manufacture any of the chairs with features described herein. For example, embodiments of the invention include a method including manufacturing a chair that has a seat and a back support connected to the seat. For example, the back support may be manufactured so that it has a flexible spine.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A chair for supporting a user, said chair comprising:
a seat;
a back support including a chair spine and at least one support surface that is configured to be adjacent to a spine of said user; and
a connector that provides a flexible connection between said seat and said back support, wherein said connector is substantially located at a position higher than an uppermost seating surface of said seat and is configured to be adjacent to a pelvis or a lumbar spine of said user;
wherein said flexible connection is configured to enables said back support to move through a sidebending range of motion from a left side of said user to a right side of said user, while said connector remains substantially fixed during said movement of said user providing a pivot point for said movement;
wherein said flexible connection is further configured to provide a return force for returning said back support to an upright position after said sidebending movement.

2. The chair of claim 1 wherein said flexible connection can be adjusted to restrict said range of motion.

3. The chair of claim 1 wherein said flexible connection can be adjusted to increase said range of motion.

4. The chair of claim 1 wherein a bottom edge of said back support is shaped as an arc of a circle to allow said movement within said sidebending range of motion.

5. The chair of claim 1 wherein said seat comprises:

said uppermost seating surface with an outer layer including at least one vent;

a seat pan that connects to said upper seat surface to create an interior housing; and at least one channel adjacent to said interior housing at a first end and adjacent to said outer layer at a second end;

wherein said at least one vent aligns with said second end of said at least one channel to enable air to flow between said interior housing and an exterior of said outer layer.

6. The chair of claim 5 wherein said at least one channel includes at least two channels that are adjacent to at least two edges of said upper seat surface.

7. The chair of claim 5 wherein said seat pan includes at least one vent that enables the flow of air between said interior housing and an exterior of said seat pan.

8. The chair of claim 1 wherein said back support further comprises:

a structural back support;

a flexible spine connected to said structural back support;

a thoracic support that is connected to said flexible spine and is adjacent to a portion of said user's thoracic spine, wherein said thoracic support includes a convex surface that contacts said user; and a lumbosacral support that is connected to said flexible spine and is adjacent to a portion of said user's lumbar spine, wherein said lumbosacral support includes a concave surface that contacts said user.

9. The chair of claim 8 wherein said thoracic support and said lumbosacral support are capable of independently flexing in response to said user.

10. The chair of claim 1 wherein said back support includes sensors to determine a position of the user on said chair.

11. The chair of claim 1 wherein said seat includes sensors to determine a position of the user on said chair.

12. A chair for supporting a user, said chair comprising:

a seat with a seating surface;

a connector that provides a flexible connection between said seat and a back support, wherein said flexible connection is higher than said seating surface and is configured to be adjacent to a pelvis or a lumbar spine of said user; and said back support comprising:

a structural back support;

a flexible spine connected to said structural back support;

a thoracic support that is connected to said flexible spine through a first support connection and is configured to be adjacent to and surround a portion of said user's thoracic spine; and a lumbosacral support that is connected to said flexible spine through a second support connection and is configured to be adjacent to and surround a portion of said user's lumbar spine;

wherein said flexible connection enables said back support to move through a sidebending range of motion from a left side of said user to a right side of said user, and wherein said flexible connector remains substantially fixed during said movement of said user;

wherein said flexible connection is further configured to provide a return force for returning said back support to a neutral position after said sidebending movement by said user.

13. The chair of claim 12 wherein said flexible connection provides a pivot point that is adjacent to said seating surface for said back support to move in said sidebending range of motion.

14. The chair of claim 12 wherein said thoracic support includes a convex surface that is configured to contact said user and said lumbosacral support includes a concave surface that is configured to contact said user.

15. The chair of claim 12 wherein said seat includes at least one vent on an outer layer of said seat that aligns with at least one channel within said seat to enable air to flow between an interior housing of said seat and an exterior of said outer layer.

16. The chair of claim 12 wherein said back support and said seat include sensors to determine the position of said user on said chair.

17. A chair for supporting a user, said chair comprising:

a seat;

a back support including a flexible spine and at least one support surface that is configured to be adjacent to a spine of said user; and a connector that provides a connection between said seat and said back support;

wherein said connection enables said back support to move through a sidebending range of motion, while said connector remains substantially fixed during said movement of said user, and said connection provides a resistance to assist a return of said back support to a neutral position after said sidebending range of motion;

wherein said sidebending range of motion aligns with said back support;

wherein said connector provides a pivot point of said sidebending range of motion that is located substantially above an upper seating surface of said seat and is configured to be adjacent to a pelvis or a lumbar spine of said user.

18. The chair of claim 17 wherein said back support further comprises:

a structural back support that is connected to said flexible spine;

a thoracic support that is connected to said flexible spine and is adjacent to a portion of said user's thoracic spine, wherein said thoracic support includes a convex surface that is configured to contact said user; and a lumbosacral support that is connected to said flexible spine and is adjacent to a portion of said user's lumbar spine, wherein said lumbosacral support includes a concave surface that is configured to contact said user.

19. The chair of claim 17 wherein said back support further comprises a structural support that supports said flexible spine.

* * * * *